US007704654B2

(12) United States Patent
Yamazaki et al.

(10) Patent No.: US 7,704,654 B2
(45) **Date of Patent: *Apr. 27, 2010**

(54) IMAGE FORMING METHOD

(75) Inventors: Hiroshi Yamazaki, Hachioji (JP); Meizo Shirose, Hachioji (JP); Masafumi Uchida, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 261 days.

This patent is subject to a terminal disclaimer.

(21) Appl. No.: 11/052,906

(22) Filed: Feb. 9, 2005

(65) Prior Publication Data

US 2005/0181289 A1 Aug. 18, 2005

(30) Foreign Application Priority Data

Feb. 12, 2004 (JP) ..... 2004/034700

(51) Int. Cl.
*G03G 15/01* (2006.01)

(52) U.S. Cl. ..... 430/45.5; 430/47.1; 430/47.2; 430/123.2; 430/125.3; 399/261; 399/318

(58) Field of Classification Search ..... 430/125.3, 430/120.1, 123.2, 45.5, 47.2, 47.1; 399/261, 399/319

See application file for complete search history.

(56) References Cited

U.S. PATENT DOCUMENTS 2,297,691 A 10/1942 Carlson
5,708,940 A * 1/1998 Hosaka et al. ..... 399/266
6,475,689 B2 11/2002 Yamazaki et al.
6,656,653 B2 * 12/2003 Mitsuhashi et al. .... 430/108.23
7,361,443 B2 * 4/2008 Yamazaki et al. ..... 430/125.3
2002/0136976 A1 9/2002 Ohmura et al.
2005/0277050 A1 12/2005 Yamazaki et al.
2006/0040198 A1 * 2/2006 Yamazaki et al. ..... 430/124

FOREIGN PATENT DOCUMENTS

JP 2001-100546 4/2001
JP 2001-117381 4/2001
JP 2002049164 2/2002
JP 2002-214821 7/2002
JP 2004061587 2/2004

OTHER PUBLICATIONS

Diamond, Arthur S & David Weiss (eds.) Handbook of Imaging Materials, 2nd ed.. New York: Marcel-Dekker, Inc. (Nov. 2001) pp. 164-168.*
English Language Derwent Abstract for JP 2004061587.
English Language Derwent Abstract for JP 2002049164.

* cited by examiner

*Primary Examiner*—Christopher RoDee
(74) *Attorney, Agent, or Firm*—Finnegan, Henderson, Farabow, Garrett & Dunner, L.L.P.

(57) ABSTRACT

An embodiment may be an image forming method, which comprises forming a latent image on an image carrier; developing the latent image with a toner to form a toner image on the image carrier; transferring the toner image; and applying ultrasonic vibration at one of the developing step and the transferring step. The toner comprises a resin particle and a release agent particle having a melting point in a range of 40 to 75° C. and the toner has Dp50 of 3.0 to 5.0 μm.

20 Claims, 6 Drawing Sheets

FIG. 6 ( a )
TONER PARTICLES
HAVING NO CORNER
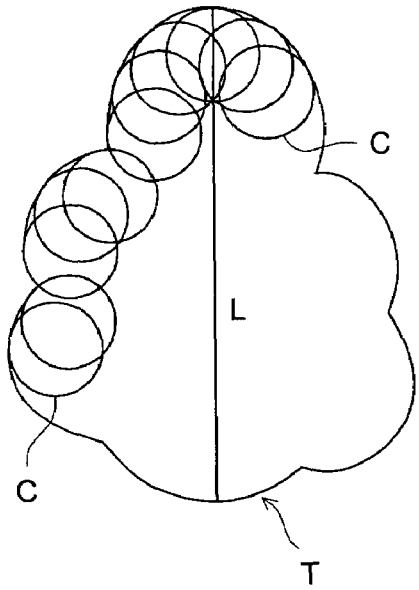
FIG. 6 ( b )
TONER PARTICLES
WITH CORNERS
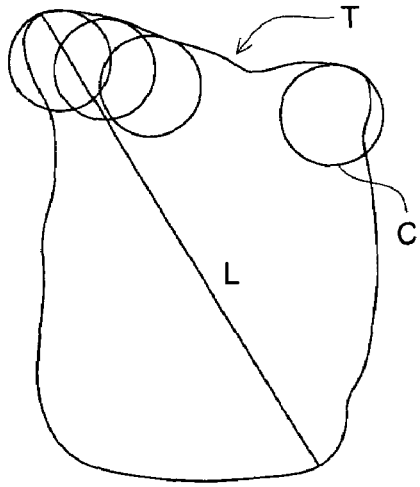
FIG. 6 ( c )
TONER PARTICLES
WITH CORNERS
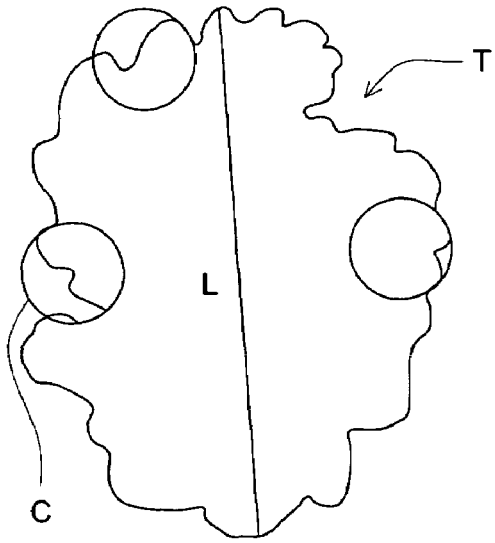

IMAGE FORMING METHOD

BACKGROUND OF THE INVENTION

1. Field of the Invention

The present invention relates to an image forming method to form a toner image on a transfer material by toner containing a resin particle and a release agent having melting point in a specific range and by utilizing ultrasonic vibration.

2. Related Art

A digital system is presently the main current of image forming of a type of an electrophotographic system, and there is given a full-color image forming technology as one of the trends of that technology. As one of the technologies to promote color toner images, there is in existence the one that forms full-color toner images by using oilless toner wherein much release agents are contained in toner particles (for example, TOKKAI No. 2002-214821 (see Paragraph 0049)).

In the digital image forming, a small dot image on a level of 1200 dpi (the number of dots per 1 inch which is 2.54 cm) is sometimes visualized. Therefore, images are formed by using toner that is in a size of several microns called a small particle size toner.

In image forming by a small particle size toner, there has been a tendency that transferability is worsened when toner images formed on the surface of a photoconductor are transferred onto a transfer material such as a sheet of paper or OHP film. In particular the tendency is remarkable in full-color image forming to form toner images by superposing Y color toner, M color toner and C color toner, and thus, it has been impossible to transfer toner images from the photoconductor surface or from an intermediate transfer object stably and surely, which has made it difficult to form color images having excellent color balance and density on a transfer material.

Accordingly, there have been studied technologies to transfer toner images surely onto a recording medium by giving physical operations on the photoconductor, and as one means thereof, there is a technology wherein ultrasonic waves are applied on an image carrier that holds toner images when transferring toner images onto a transfer material, and thereby, toner images are transferred efficiently onto a transfer material from the surface of the image carrier by the actions of vibrations generated from the ultrasonic waves (for example, TOKKAI No. 2001-100546 (see Paragraph 0022) and TOKKAI No. 2001-117381 (see Paragraph 0035).

However, transfer of toner images employing supersonic waves disclosed in TOKKAI No. 2001-100546 or TOKKAI No. 2001-117381 has been one developed for the toner for which oil is coated on a transfer material in the course of fixing. So, image forming was tried through this transfer method by using oilless toner, in vain. When transfer by means of ultrasonic waves was tried by using oilless toner, release agents were removed from toner particles by the actions of vibrations coming from the ultrasonic waves, resulting in the problem that a transfer material wound itself round a fixing roller in the fixing process, and offsetting was caused.

Since externally added agents have also been removed from the oilless toner together with the release agents, toner images were easily disturbed by the influence of vibration by ultrasonic waves, because of the tendency that force of adhesion to the photoconductor is increased and transfer rate is lowered, thus, it was difficult to superpose each monochromatic toner image correctly on a full-color image.

SUMMARY

An embodiment can be an image forming method, which comprises: employing ultrasonic wave vibrations when developing toner on an image carrier or when transferring a toner image, wherein toner comprises a resin particle and the toner contains a release agent particle whose melting point is in a range of about 40-about 75° C., and the toner has particle diameter (Dp50) at 50 percent accumulation in a number-based particle size distribution in a range of about 3.0-about 5.0 μm.

BRIEF DESCRIPTION OF THE DRAWINGS

FIG. 6 is a schematic diagram showing a profile view of toner particles having no corner and toner particles having a corner.

DETAILED DESCRIPTION OF THE PREFERRED EMBODIMENT

Figure 1:
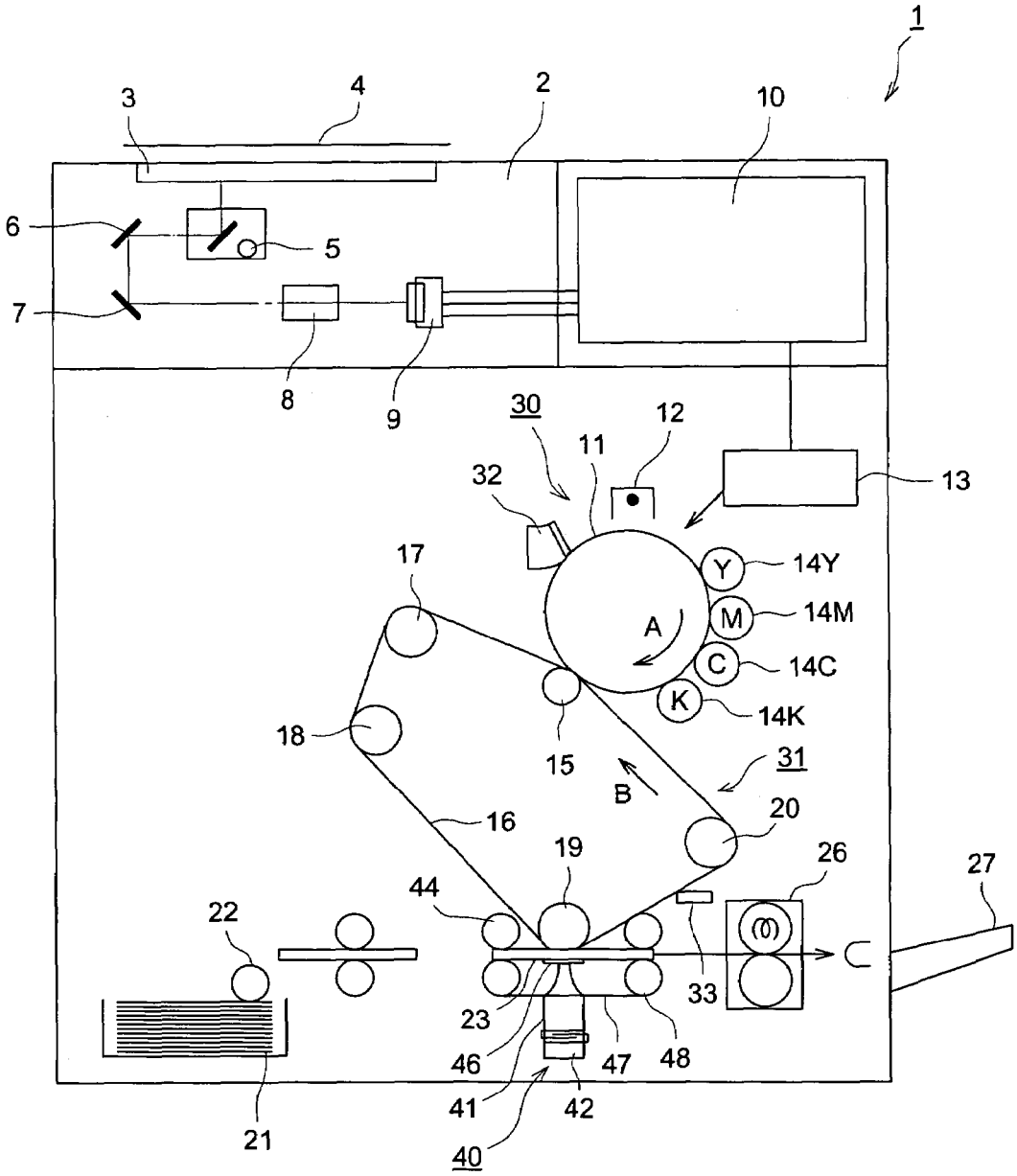
FIG. 1 is a schematic illustration showing an example of image forming apparatus preferably employed in the invention.

An embodiment of the invention has been achieved in view of the problems stated above, and its object may be set to provide an image forming method having at least a transfer process using ultrasonic waves, wherein the problem that a transfer material winds itself round a fixing roller, and offsetting is caused, can be prevented by using toner in which release agents are not removed from toner particles, for image forming.

Further object of an embodiment can be to provide an image forming method wherein toner images are not disturbed even when they receive vibrations from ultrasonic waves and a toner image of each color can be superposed correctly on another toner image, and a full-color image having high image quality can be formed.

Inventors presumed that when ollless toner particles received ultrasonic wave vibrations, a release agent layer in the toner particles was influenced by the vibrations preferentially and selectively in the toner particles, resulting in concentration of the influences of the vibrations by ultrasonic waves on the release agent layer, which made the release agent layer to be removed from the toner particles.

Based on this presumption, the inventors studied a method to prevent from removal of a release agent layer from toner particles, and found out that removal of a release agent layer from toner particles caused by the influence of ultrasonic waves can be prevented by in image formation employing oilless toner described below, to form excellent images.

Structure 1: An image forming method employing ultrasonic wave vibrations when developing toner on an image carrier or when transforming a toner image on a transfer material, wherein toner is formed by agglomerating resin particles and release agent particles whose melting point is in a range of 40-75° C., and a number average particle size is in a range of 3.0-5.0 μm.

In the structure (1) above, it is preferable that the toner has a coefficient of variation of a form factor being 14% or less and a number coefficient of variation in a number particle size distribution being in a range of 18-24%.

It is preferable that the toner contains 65 number % or more of toner particles whose form factor is in a range of 1.05-1.55.

It is also preferable that the toner contains 50 number % or more of toner particles each having no corner.

By at least the structure 1, even when transfer employing ultrasonic wave vibrations was conducted, release agents tend not to be removed from toner particles, and it has become possible to form excellent images. The reasons why release agents were not removed from toner particles and why effective transfer functions were realized under the presence of ultrasonic wave vibrations in the structure 1 are not clear. However, it is estimated that the interface between a release agent layer and a resin layer is stabilized by a compound having a melting point in a specified specific temperature range for the release agents, and thereby, the release agent layer was not removed from toner particles even when it received vibrations from ultrasonic waves.

As stated above, when a compound having a melting point in a specific temperature range is employed as a release agent, a release agent layer is not removed from toner particles and it can be stabilized even when ultrasonic wave vibrations are applied on oilless toner. As a result, a release agent layer is not removed from toner particles in the process where ultrasonic wave vibrations are used, and there have been solved troubles that a transfer material on which a toner image is formed winds itself round a fixing roller or offset is caused. Further, it has become possible to superpose correctly a toner image of each color, which, therefore, has made it possible to form stably an excellent full-color image that is free from disturbed image.

Further, by using the toner of at least the structure 1 for image forming, a release agent layer is hardly removed from toner particles. Therefore, it has made it possible that durability of the toner has been improved. As a result, in the image forming having the process using ultrasonic waves, a release agent layer is not removed from toner particles in spite of an influence of ultrasonic waves, which has made stable image forming possible.

It has become possible to prevent removal of a release agent layer even when toner particles receive vibrations in the image forming process employing ultrasonic waves vibrations, by conducting image forming by the use of toner particles which are formed by agglomerating resin particles and release agent particles whose melting point is in a range of 40-75° C., and their number average particle size is in a range of 3.0-5.0 μm. As a result, troubles of winding of a transfer material round a fixing roller and offset both are caused by removal of release agent from toner particles have been solved, and it has become possible to form images stably.

Further, the problem of disturbed images has been solved, because it has become possible for toner particles to be free from the influence of vibrations in the course of image forming, resulting in stable obtaining an excellent full-color toner image wherein toner images each having each color are superposed correctly.

Initially toner is described hereinafter.

The particle diameter (Dp50) at 50 percent accumulation in a number-based particle size distribution (hereinafter it may be called Dp50) of toner particles can be commonly 3.0-5.0 μm, but is preferably 3.5-4.0 μm. It is possible to control Dp50 of toner particles by varying the concentration or timing to feed coagulants (salting-out agents), or the temperature, during the production process.

By employing specified range of Dp50 of the toner particles, it has been confirmed that the aforesaid drawbacks can be not only overcome, but also fine line reproduction and dot images can be markedly improved. It is also applicable to digital image formation at the level of 1,200 dpi.

Further, Dp50 of toner particles can be measured by Coulter Counter TA-II (produced by Coulter Inc.). Measurement and calculation are performed by TA-II by connecting a size distribution outputting interface (produced by Nikkaki Co.) and a personal computer.

Further, to meet the demand in recent years for oil-free fixing if desired, it is possible to add release agents. By incorporating release agents, it is possible to omit peeling aids such as silicone oil which have conventionally been provided on the surface of fixing members, whereby it is possible to minimize non-uniform glossiness due to migration of peeling aids to fixing substrates (paper sheets). Consequently, since the structure of the fixing apparatus itself can be simplified, it is effective to reduce the size of such devices.

Listed as specific examples of release agents used herein may be low molecular weight polyolefins such as polyethylene, polypropylene, or polybutene; silicones which exhibit a specific softening point when heated; fatty acid amides such as oleic acid amide, erucic acid amide, recinoleic acid amide, or stearic acid amide; plant based wax such as carnauba wax, rice wax, candelilla wax, Japan wax, or jojoba oil; animal based wax such as beeswax; mineral and petroleum based wax such as montan wax, ozokerite, ceresin wax, paraffin wax, microcrystalline wax, or Fischer-Tropsch wax; esters of higher fatty acids with higher alcohols such as stearyl stearate, behenyl behenate, or myristyryl myristate; ester wax of higher fatty acids with monohydric or polyhydric lower alcohols such as butyl stearate, monostearic acid glyceride, distearic acid glyceride, or pentaerythritol tetrabehenate; ester wax composed of higher fatty acids such as distearic acid diglyceride, or tetrastearic acid glyceride with polyhydric alcohol; sorbitan higher fatty acid ester wax such as sorbitan monostearate; and cholesterol higher fatty acid ester waxes. These release agents may be employed individually or in combinations of at least two types.

The added amount of these release agents is commonly 0.5-50 percent by weight to the toner, is preferably 1-30 percent by weight, but is more preferably 5-15 percents by weight. By controlling the added amount of release agents in such a range, oozing on the surface of images is sufficiently performed, whereby desired releasing properties are not only generated but also full color images of sufficient transparency, are obtained when images are formed on OHT sheets.

Further, by employing toner which incorporated release agents of a melting point of in the range of 40-75° C., stable image forming performance can be exhibited via the image forming apparatus which performed a transfer process using ultrasonic vibration. Namely, in release agents of a melting point in the range of 40-75° C., it is assumed that a strong adhesion action in the interface between the resinous components forming toner particles, and the release agent components is generated and even though the toner is affected by ultrasonic vibration during image formation, release agents are not released from the toner particles, whereby even if the toner is subjected to vibrations, stable image formation results.

As release agents which exhibit such action effects, monohydric alcohol ester compounds of fatty acids such as behenyl behenate, stearyl stearate, myristyl myristate, as well as distearyl sebacate are particularly preferred.

The melting point of the release agent can be measured by a differential scanning calorimeter DSC-7 (produced by Perkin-Elmer Corp. with following condition.

Sample: 5-20 mg, preferably 10 mg

Method: Sample is placed in the aluminum pan. As reference, empty aluminum pan is used.

Temperature curve:

Heating temperature I (20 to 180° C., Rate 10° C./min.)

Cooling temperature I (180 to 10° C., rate 10° C./min.)

Heating temperature I I (10 to 180° C., rate 10° C./min.)

The melting point is regarded as the temperature at the peak top of the endothermic peak in Heating temperature I I.

The melting point of release agent can be measured from toner if the endothermic peak is clearly understood as the one of the release agent.

The shape of toner particles will now be described. Toner particles which exhibit at least one of following shape characteristics are preferably employed, namely the ratio of toner particles which exhibit a variation coefficient of the shape factor of at most 14 percent, a number variation coefficient in the number particle size distribution of 18-24 percent, and/or a shape factor in the range of 1.05-1.55 is at least 65 percent by number. When full color images are formed employing toner of such a shape, the surface properties between toner particles of each color become uniform, whereby it makes it possible to achieve image formation which exhibits more stabilized developability and transferability.

Further, the resulting static charge amount distribution is narrowed and chargeability among toner particles of each color becomes uniform, whereby adhesion properties to image forming supports become uniform among toner particles. As a result, since toner of each color uniformly adheres to transfer materials, it makes it possible to form full color images which are faithful reproductions of the original images.

Consequently, consistent formation of high quality full color images of excellent color reproduction, as well as of fine line reproduction, over an extended period of time can be provided.

Further, controlling the ratio of toner particles without corners to be at least 50 percent by number, has made it possible to consistently form high quality full color images of better color reproduction as well as of better fine line reproduction over an extended period of time, even though having the image forming process employing ultrasonic vibration.

<Shape Factor of Toner Particles>

As used herein, the term "shape factor" refers to the value represented by Formula (A), described below, and represents the degree of roundness of toner particles.

$$\text{Shape factor}=(\text{maximum diameter}/2)^2\times\pi)/\text{projected area}) \qquad \text{Formula (A):}$$

The maximum diameter, as described herein, refers to the width of a particle which is determined in such a manner that when the projected image of the toner particle onto a plane is interposed by two parallel lines, the resulting width of the parallel lines reaches a maximum value. Further, the projected area, as described herein, refers to the area of the projected image of a toner particle onto a plane.

In the present invention, the shape factor is determined in such a manner that images of toner particles magnified at a factor of 2,000 employing a scanning type electron microscope are captured, and the resulting images are subjected to photographic image analysis employing "SCANNING IMAGE ANALYZER" (produced by Nippon Electronics Co.). At that time, 100 toner particles are employed and the shape factor is determined based on the above calculation formula.

It is preferable that the toner employable is constituted so that the ratio of toner particles in the range of the shape factor of 1.05-1.55 reaches at least 65 percent by number.

By controlling the ratio of toner particles of the shape factor in the range of 1.05-1.55 to be at least 65 percent by number, surface properties among toner particles become uniform, whereby fluctuation of transferability onto image forming supports is minimized, which enables stable transferability. Further, toner particles become not readily crushable. Consequently, it is assumed that charge providing members are less stained and chargeability of the toner is stabilized, whereby fluctuation of adhesion properties onto electrostatic latent image carriers among toner particles of each color is minimized, making it possible to consistently form color images.

Methods for controlling the above shape factor are not particularly limited, but the method disclosed in the above-mentioned JA-P No. 2001-318482, for example, is preferred.

<Variation Coefficient of Shape Factor of Toner>

The "variation coefficient of shape factor" of the toner is calculated based on Formula (B) below:

$$\text{Variation coefficient}=[S_1/K]\times 100(\%) \qquad \text{Formula (B):}$$

wherein $S_1$ represents the standard deviation of the shape factor of 100 toner particles, while K represents the average value of the shape factor.

It is preferable that the above variation coefficient of the shape factor is controlled to be at most 14 percent. By controlling the variation coefficient of the shape factor to be at most 14 percent, surface properties among toner particles of each color can become uniform, and even in a state provided with ultrasonic vibration, fluctuation of transferability onto transfer materials can be decreased, whereby stabilized transferability can be obtained. Further; toner particles become not readily crushable and charge providing members are less stained to stabilize the chargeability of the toner. As a result, fluctuation of adhesion properties onto electrostatic latent image carriers is decreased, whereby it is possible to consistently form color images.

In order to uniformly control the shape factor, and the variation coefficient of the shape factor, of the above toner under minimal lot fluctuations, during the process of the preparation (polymerization) of resinous particles to constitute the toner, the fusion of the above resinous particles, and the shape control, it may decide the proper time to finish while monitoring the characteristics of the toner particles during their formation.

As used herein, the term "monitoring" means that measurement devices are arranged in the form of in-line, and based on the measurement results, processes are controlled. Namely, a device to measure the shape is arranged in the form of in-line, and for example, in the case of a polymerization method toner which is formed by coalescing or fusing resinous particles in a water-based medium, during the fusion process, sampling is successively performed and the resulting shape as well as the resulting particles diameter is determined. When the desired shape is achieved, the reaction is terminated.

Monitoring methods are not particularly limited, but it is possible to use a flow process particle image analyzer FPIA- 2000 (produced by Toa Medical Electronics Co.). The above analyzer is appropriately employed, since it is possible to perform image processing in real time, while drawing liquid samples. Namely, monitoring is always performed employing samples drawn from the reaction site employing a pump, and the resulting shape is determined. When the desired shape is achieved, the reaction is terminated.

Further, the number particle size distribution and the number variation coefficient of toner are determined employing COULTER COUNTER TA-II (produced by Coulter Co.) connected to a particle size distribution outputting interface (produced by Nikkaki Co.) and a personal computer. In the Coulter COUNTER TA-II, a 100 μm aperture was used, and the volume and the number of toner particles of at least 2 μm are determined and the particle size distribution as well as the average particle size was calculated. As used herein, the term, "number particle size distribution" represents the relative frequency with respect to the particle diameter, while "Dp50" represents the median diameter in the number particle size distribution. "Number variation coefficient in the number particle size distribution" is calculated based on Formula (C) below:

$$[S_2/D_n]\times 100(\text{in percent}) \qquad \text{Formula (C):}$$

wherein S2 represents the standard deviation in the number particle size distribution, while $D_n$ represents Dp50 (in μm).

When the number variation coefficient of toner is 18-24 percent, the toner results in uniform surface properties among toner particles. As a result, fluctuation of transferability onto image forming supports can be minimized, whereby consistent transferability can be achieved. Further, toner particles are not readily crushed, whereby charge proving members are less stained and chargeability of the toner is stabilized. Consequently, it is assumed that fluctuation of adhesion properties onto electrostatic latent image carriers decreases to contribute to the formation of consistent toner images.

In the case in which fixed color images are formed via an intermediate transfer body, it is possible to maintain desired transferability due to an increase in packing density of toner particles in the toner layer transfer-formed on the intermediate transfer body.

Methods to control the number variation coefficient in the toner are not particularly limited, but the method disclosed in the above JP-A No. 2001-318482 can be available.

It is preferable that the ratio of toner participles without corners is controlled to be at least 50 percent by number.

By controlling the ratio of toner particles without corners to be at least 50 percent by number, surface properties among toner particles of each color become uniform to minimize fluctuation of transferability onto image forming supports, whereby stable transferability is achieved. Further, toner particles which tend to be subjected to abrasion and breakage, and have portions at which electric charges are concentrated, decrease, and the charge amount distribution is narrowed to stabilize chargeability among toner particles of each color, whereby it is possible to consistently form excellent color images over an extended period of time.

As described herein, the term "toner particles without corners" refers to toner particles which substantially have neither projections at which electric charges are concentrated nor projections which are readily subjected to abrasion due to stress, and specifically, the toner particles described below are designated as toner particles without corners. Namely, as shown in FIG. 6(*a*), the major axis of toner particle T is represented by L, and circle C of radius (L/10) is rolled within the interior periphery of toner particle T while brought into contact with one point of the interior periphery. When above circle C does not substantially extend into the exterior, the toner particle is designated as a "toner without corners". As used herein, the "case in which circle C does not substantially extend into the exterior" refers to the case in which the number of projections existing in the circle which extend into the exterior is at most one. Further, the "major axis of the toner particle", as described herein, refers to the length of the particle which is determined in such a manner that when the projected image of the above toner particle on a plane is interposed employing two parallel lines, the interval between the parallel lines becomes maximum. Incidentally, FIGS. 6(*b*) and 6(*c*) each show a projected image of a toner particle with corners.

The ratio of particles without corners is determined as follows. Initially, an enlarged image of toner particles is captured employing a scanning type electron microscope, and the image is further enlarged to a factor of 15,000. Subsequently, based on the resulting image, the presence of the aforesaid corners is determined. The above determination is performed for 100 particles.

Methods to obtain toner without corners are not particularly limited, but the method disclosed in JP-A No. 2001-318482 is preferably employed.

Further, it is confirmed that uniformity of the shape of toner particles constituting yellow toner, magenta toner, cyan toner, and black toner employed to form full color images (with minimum fluctuation among toner particles of each color) enhances color reproduction.

Namely, by satisfying Formulas (1)-(4) described below, in the case in which color images are formed employing the tandem system, it is possible to decrease fluctuation of adhesion properties and chargeability among toner particles of each color and to enhance color reproduction. Further, it is possible to minimize degradation of image quality during the transfer process as well as the fixing process, whereby it is possible to form desired color images.

$$0\leqq[(\text{maximum value of } K)-(\text{minimum value of } K)]/(\text{maximum value of } K)\leqq 0.20 \qquad \text{Formula 1:}$$

$$0\leqq[(\text{maximum value of } K\sigma)-(\text{minimum value of } K\sigma)]/(\text{maximum value of } K\sigma)\leqq 0.30 \qquad \text{Formula 2:}$$

$$0\leqq[(\text{maximum value of } D)-(\text{minimum value of } D)]/(\text{maximum value of } D)\leqq 0.15 \qquad \text{Formula 3:}$$

$$0\leqq[(\text{maximum value of } D\sigma)-(\text{minimum value of } D\sigma)]/(\text{maximum value of } D\sigma)\leqq 0.25 \qquad \text{Formula 4:}$$

In above Formulas (1)-(4), the maximum value and the minimum value of K refer respectively to the maximum value and the minimum value among average values (Ky, Km, Kc, and Kb) of the shape factor of each of the yellow toner, magenta toner, cyan toner, and black toner; the maximum value and the minimum value of Kσ refer respectively to the maximum value and the minimum value among the variation coefficients (Kσy, Kσm, Kσc, and Kσb) of the shape factor of each of the color toners; the maximum value and the minimum value of D refer respectively to the maximum value and the minimum value among Dp50(Dy, Dm, Dc, and Db) of each of the colors; and the maximum value and the minimum value of Dσ refer respectively to the maximum value and the minimum value among the number variation coefficients (Dσy, Dσm, Dσc, and Dσb) in the number particle size distribution of each of the color toners.

Further, when a histogram showing a number-based particle size distribution of the toner is prepared in such a manner that when natural logarithm D, lnD, wherein D (in μm) represents the particle diameter, is plotted on the abscissa and the resulting abscissa is divided into a plurality of classes at an interval of 0.23. It is preferable that the sum (M), of the relative frequency (m1) of toner particles included in the most frequent class and the relative frequency (m2) of toner particles included in the second most frequent class, is at least 70 percent.

When sum (M) of relative frequency (m1) and relative frequency (m2) is at least 70 percent, the dispersion of the particle size distribution of toner particles is narrowed. By applying the above toner to image processing, it is possible to assuredly retard the generation of selective development.

The above histogram shows a number-based particle size distribution, in which natural logarithm lnD (D represents the particle diameter of each of the toner particles) is divided, at an interval of 0.23, into a plurality of classes (0-0.23: 0.23-0.46: 0.46-0.69: 0.69-0.92: 0.92-1.15: 1.15-1.38: 1.38-1.61: 1.61-1.84: 1.84-2.07: 2.07-2.30: 2.30-2.53: 2.53-2.76 . . . ). Particle size data of a sample, which are determined by Coulter Multisizer under the following conditions, are transmitted to a computer via an I/O unit, and in the above computer, the above histogram is prepared employing a particle size distribution analysis program.

(Measurement Conditions)

(1) Aperture: 100 μm (2) Method for preparing a sample: a surface active agent (a neutral detergent) is added in a suitable amount to 50-100 ml of an electrolyte (ISOTON R-11, produced by Coulter Scientific Japan Co.) and stirred. Thereafter, 10-20 mg of the sample to be measured is added to the resulting mixture. Preparation is completed by dispersing the resulting system for one minute, employing an ultrasonic homogenizer.

The image forming apparatus employable will now be described. In an embodiment of the invention, when a toner image formed on an image carrier is transferred onto a transfer material such as a paper sheet, or when an toner image formed on an image carrier is overlapped on an intermediate transfer material whereby transfer is performed, and further when the image overlapped on the intermediate transfer material is transferred on a transfer material, the toner image which is being provided with ultrasonic vibration is transferred, whereby an image is formed.

FIG. 1 is a schematic illustration showing an example of image forming apparatus preferably employed. The image forming apparatus has a drum-shaped photoreceptor 11 rotatable in the direction of arrow A as an image carrier, and an original reading section 2 to read the image of original 4 is arranged at the upper portion of the body of the color forming apparatus 1. The image reading section has a platen glass 3, a light source 5, two scanning mirrors 6 and 7, a focusing lens 8 and a color CCD sensor 9.

In the body of the color image forming apparatus 1, an image forming unit 30, an intermediate transferring member unit 31 are arranged. In the image forming unit 30, a charging device 12 for almost uniformly charging the photoreceptor drum 11, a laser beam scanning device for writing a static latent image by irradiating a laser beam to the photoreceptor drum 11, and developing devices 14Y, 14M, 14C and 14K each containing a Yellow (Y), magenta (M), cyan (C) and black (Bk) toners, respectively, are arranged around the photoreceptor drum 11.

In the intermediate transfer unit, an intermediate transfer belt 16 is provided which is suspended by a driving roller 17, idling rollers 18 and 20, and a secondary transferring backup roller 19, and the intermediate transfer belt 16 is driven by a driving roller 17 so as to be circulated in the direction of arrow B.

At the lower portion of the body of the image forming apparatus 1, a paper supplying cassette containing paper 23, a conveying roller 22 for picking up and conveying the paper 23 one by one, and a register roller 28 for conveying the paper 23 to the position facing to the intermediate transfer belt 16, are provided.

Then, an ultrasonic wave generation element 42 and a horn 41 are arranged at the portion where the intermediate transfer belt 16 is faced to the image receiving material, and they are arranged at the back side of the intermediate transfer belt.

Moreover, a fixing device 26 for fixing the toner image transferred onto the paper and a tray 27 onto which the paper after fixing is output are provided.

The ultrasonic wave device usable is explained.

Figure 4:
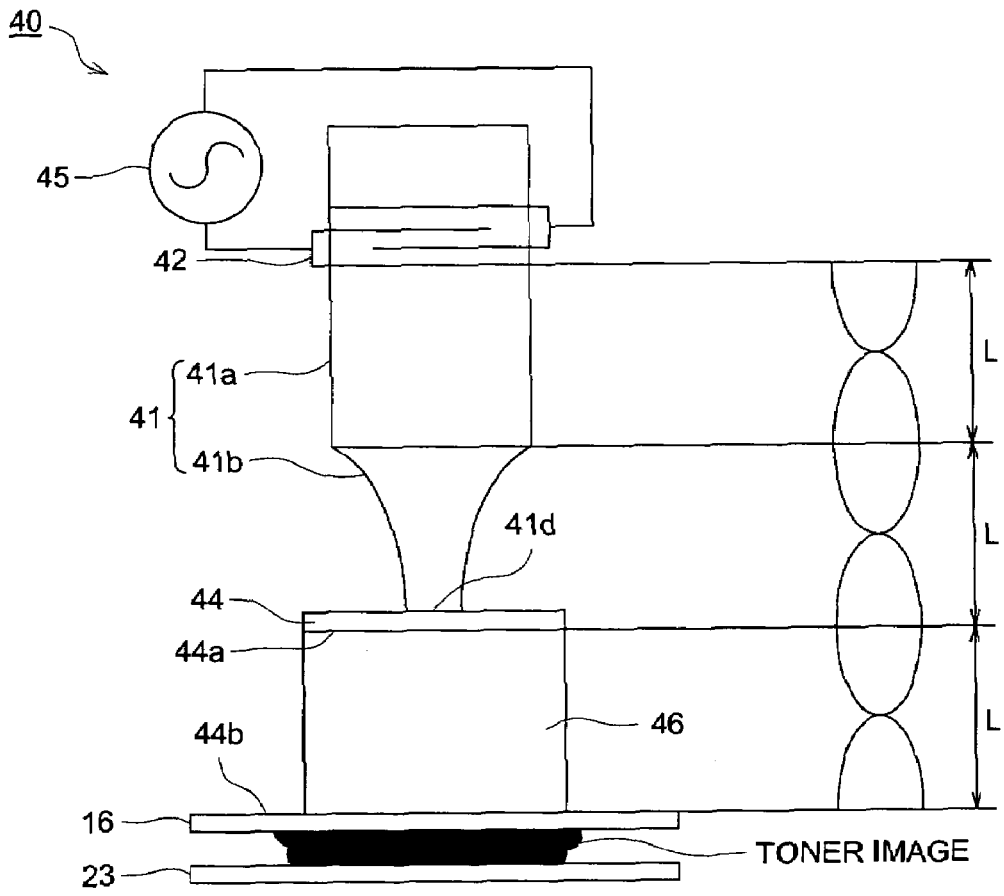
FIG. 4 is a schematic illustration showing an example of ultrasonic radiation device in the invention.

FIG. 4 is a schematic illustration of a typical ultrasonic wave apparatus 40 employable in the invention. The ultrasonic wave apparatus 40 shown in FIG. 4 is constituted by an ultrasonic wave generation element 42, a horn 41 for introducing the generated ultrasonic waves to an ultrasonic wave irradiating face 44*a*, and a high frequency power source 45.

The ultrasonic apparatus is not limited to it. As the ultrasonic wave generation element 42 shown in FIG. 4, for example, a ceramic type piezoelectric element is employed for generating strong ultrasonic waves. The ultrasonic wave generation element 42 is strongly fixed by an organic adhering agent to a straight pipe portion 41*a* of the horn 41 composed of the strait pipe portion 41*a* and a horn portion 41*b*, each of which has a length L. The length L is integer times of ½ of the sonic wavelength of L1 defined by the resonance frequency of the ultrasonic wave generation element and the sonic speed in the material.

The horn portion 41*b* is formed as a bugle-like shape in which the cross section area thereof is made so as to be gradually smaller toward from the straight pipe portion 41*a* contacted with the ultrasonic generation element 42 to the end of the horn portion 41*b*. The material constituting the horn 41 is typically SUS, and aluminum bronze, phosphor bronze, a titanium alloy and duralumin are usable other than USU.

The vibration amplitude of the ultrasonic wave generation element 42 can be amplified corresponding to the ratio of the area of the irradiating face 41*c* of the straight pipe portion 41*a* to the area of the end face 41*d* so that further strong ultrasonic waves can be irradiated.

Moreover, the fatigue or the degradation of the vibrating property caused by the vibration stress can be prevented by decreasing the vibration amplitude of the ultrasonic wave generation element 42.

In this example, the ratio of the area of the irradiation end 41*c* of the horn 41 to the area of the end face are 5:1; it has been confirmed that the vibration efficiency of the horn 41 is most effectively realized when the area ratio is near such the ratio.

Moreover, in the ultrasonic apparatus 40, an ultrasonic irradiating plate 44 is attached. In FIG. 4, the ultrasonic irradiation plate has a disc shape having a diameter of 25 cm. An ultrasonic wave irradiating face 44*a* is formed at the face of the ultrasonic irradiation plate facing to the subject.

As above-mentioned, it is made possible by the ultrasonic wave apparatus 40 that the ultrasonic waves are generated by the ultrasonic wave generation element 42 and the vibration amplitude of the ultrasonic waves is amplified by the use of the horn 41 and irradiated from the ultrasonic wave irradiation face 44*a* having a large area so that strong energy vibration is given to a wide area of the subject.

In the example, thus constituted ultrasonic wave apparatus 40 are arranged as a strait line or a staggered line in the cross direction of the intermediate transfer belt 16 to form the ultrasonic wave vibrations applying means.

It is confirmed that a frequency of from 40 kHz to 2 MHz is suitable. The frequency within such the range is preferred since the thickness of the ultrasonic wave generation element has to be thin and the output of the ultrasonic waves is difficultly made large when the frequency is made high. Moreover, in the present invention, in the image formation which conducts transferring with a frequency in the above-mentioned range, It is confirming that by using small size toner which is formed by coagulating resin particles containing a release agent which has a melting point in a range of 40-75 degrees C. and has a form near a globular and a Dp50 of 3.0-5.0 micrometers, a desirable image formation can be performed especially.

Figure 5:
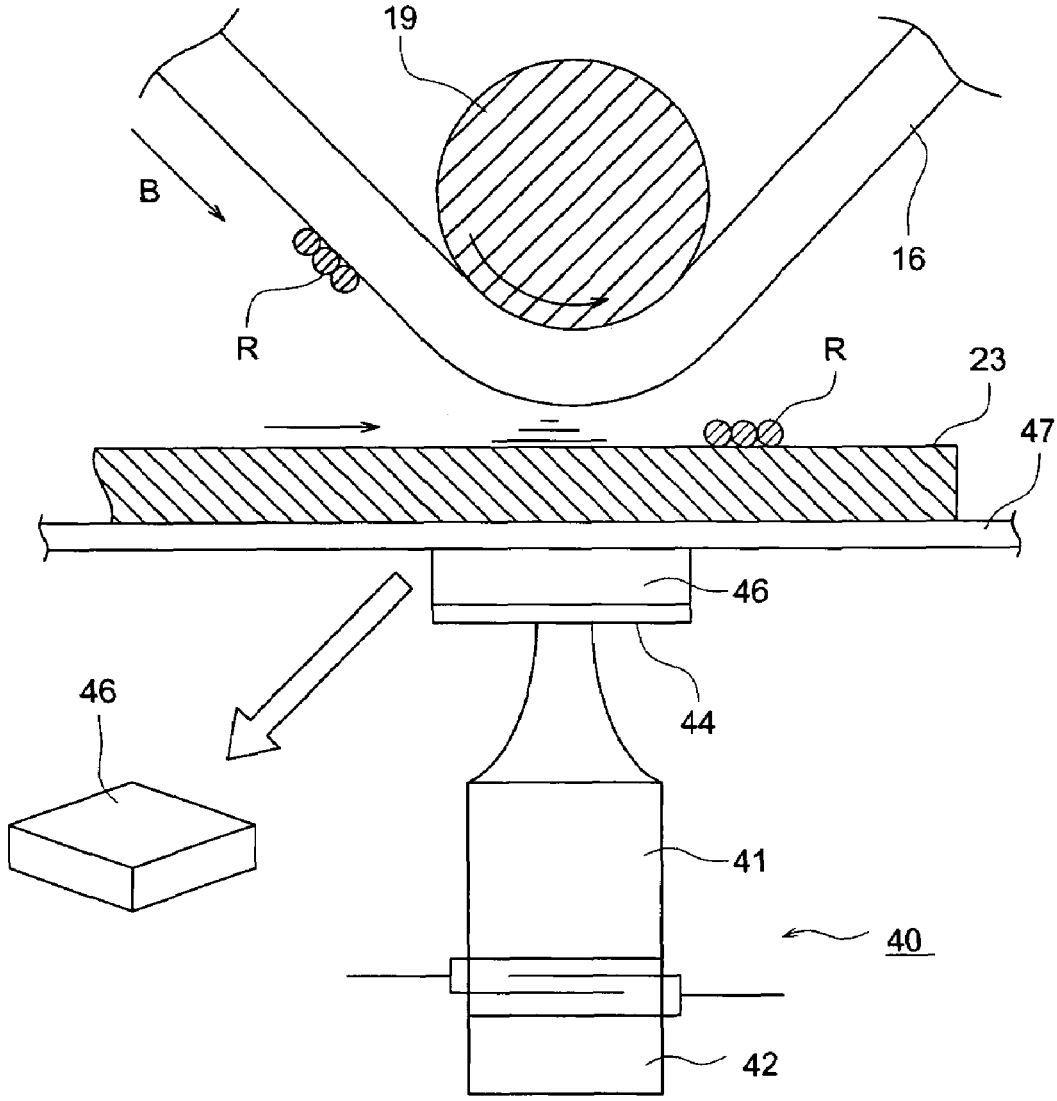
FIG. 5 is a schematic illustration showing transferring position of the intermediate transfer belt and an image receiving material (transfer material).

It is preferable to provide a sheet-shaped gel member 46 as an ultrasonic wave conducting member as shown in FIGS. 4 and 5 between the intermediate transfer belt 16 or the conveying belt 47 and the ultrasonic irradiation face for obtaining high transfer efficiency at the transferring position. Other than the sheet shaped get member, the gel member 46 may be formed by coating a gel material taken out from a tube on the ultrasonic wave irradiation plate 44.

The ultrasonic waves can be certainly conducted to the intermediate transfer belt 16, so as to raise the transfer efficiency at the transferring position by providing the ultrasonic wave conductive member at the transferring position. Moreover, the ultrasonic wave conductive member prevents rubbing the end portion of the ultrasonic wave apparatus 40 with the intermediate transfer belt 16 or the conveying belt 47 so that the members constituting the apparatus can be protected.

As the Gel Member 46, for Example, 100% Silicone is Employed and Functioned as the ultrasonic wave conducting member on the occasion of the transfer. The gel member 46 most preferable is a sheet-shaped silicone type gel. The sheet-shaped silicone gel is preferable since the sheet-shaped gel can conduct the ultrasonic wave to the facing face 44*b* while the get itself is almost not received the influence of pressure.

The silicone type gel is superior in the resistivity to heat and chemicals, and the properties thereof are almost not varied accompanied with the passing of time. Therefore, the silicone type gel can stably hold the ultrasonic wave conducting ability for long period and do not contaminate the environment, and it is confirmed that the silicone gel is superior in hygienic and environmental suitability. Concrete examples of the sheet-shaped silicone type gel include a silicone gel sheet composed of a silicone gel layer laminated on a silicone rubber layer, cf. Japanese Patent O.P.I. Publication No. 2-196453, a silicone gel sheet rubber sheet which is composed of a mesh-shaped reinforcing material such as glass cloth covered with hardened silicone rubber, cf. Japanese Patent O.P.I. Publication No. 6-155517, and a silicone gel sheet having a metal foil on one side thereof, cf. 6-201226. Any types of silicone gel sheet can be employed.

Figure 2:
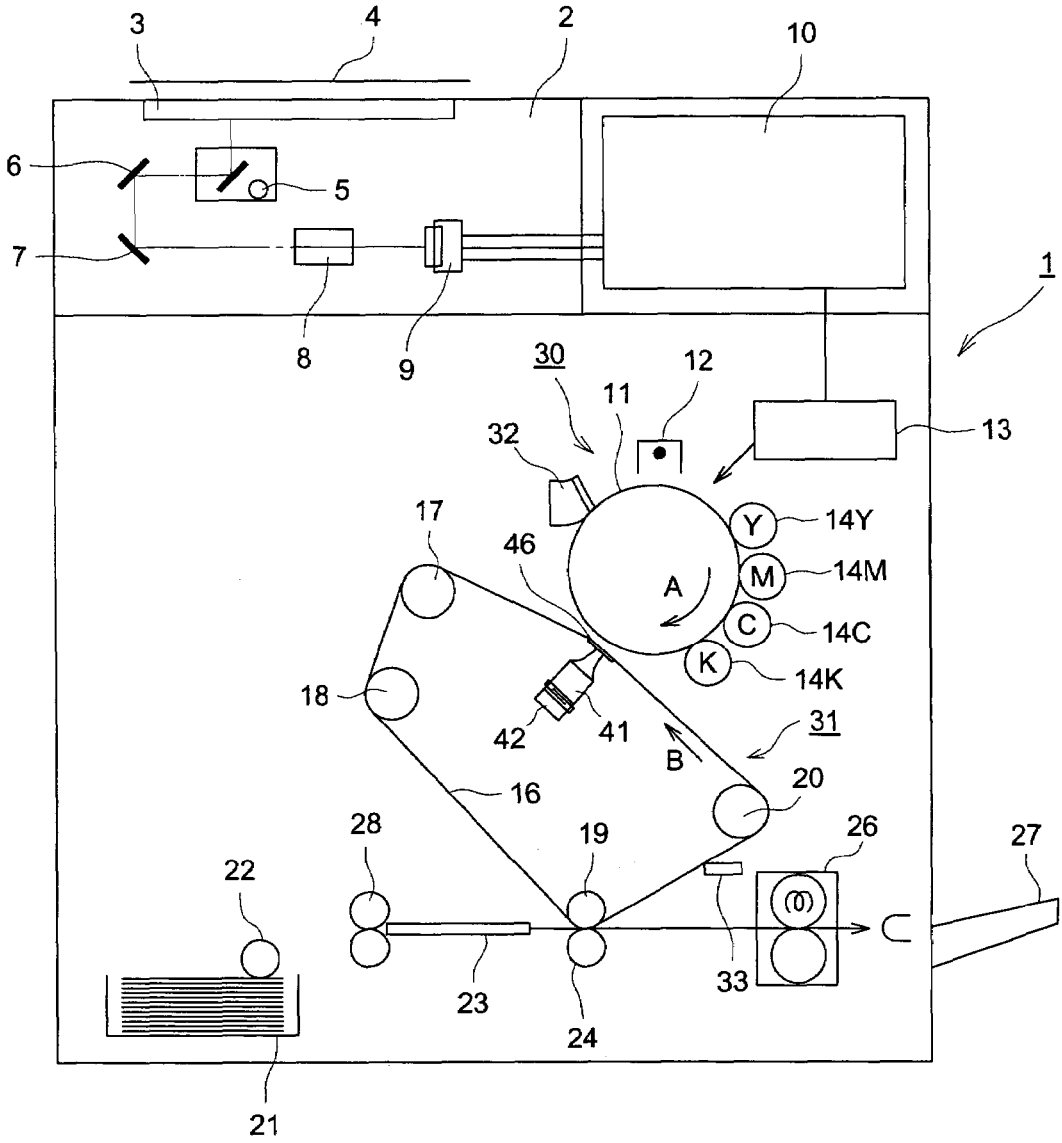
FIG. 2 is a schematic illustration showing an example of the image forming apparatus in which toner image on a photoreceptor drum is transferred to an intermediate transfer member.
Figure 3:
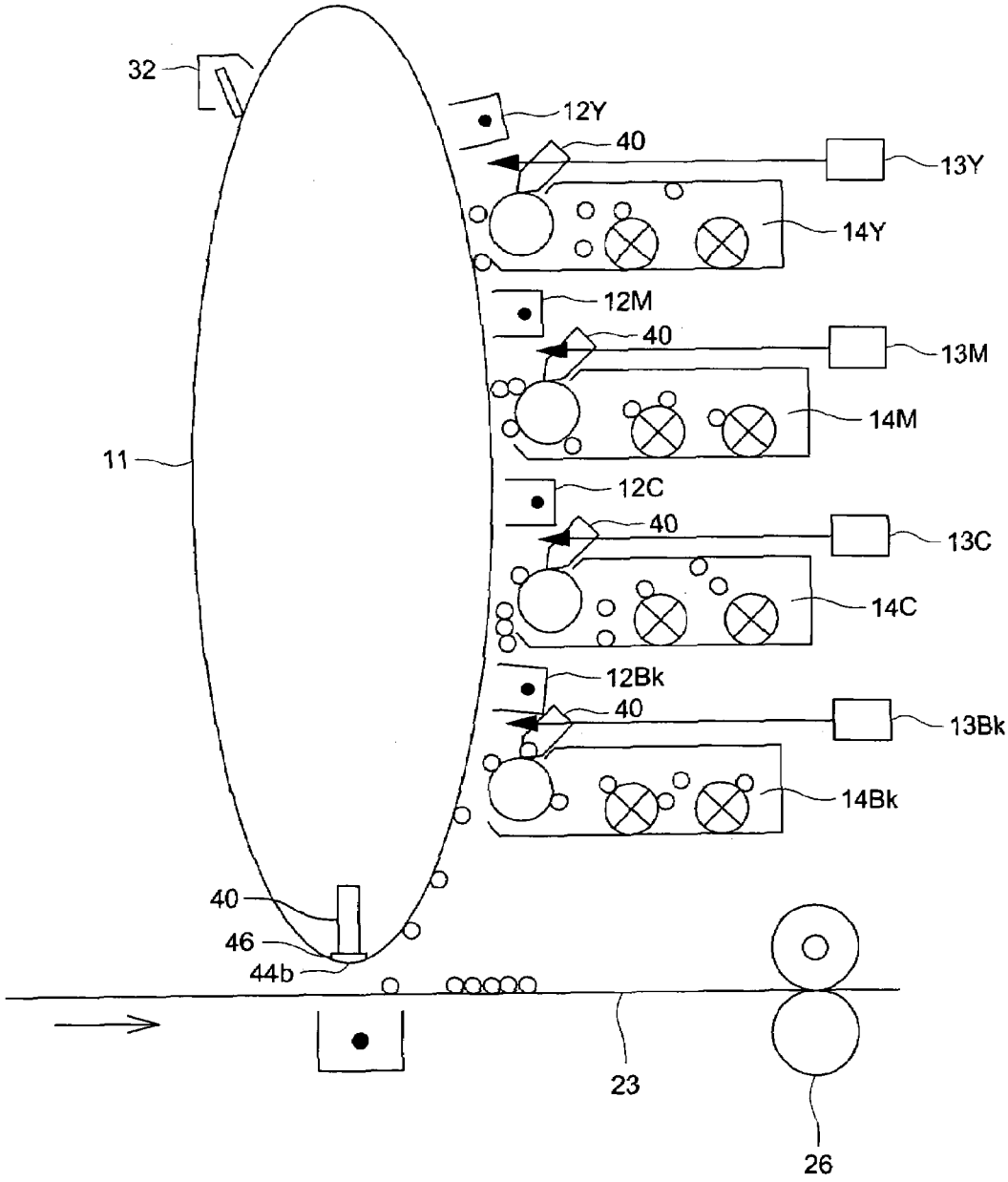
FIG. 3 is a schematic illustration showing another example of image forming apparatus employable in the invention.

In the image forming apparatus shown in FIGS. 1 to 3, the ultrasonic irradiation face 44*a* of the ultrasonic apparatus 40 is faced in parallel to the intermediate transfer belt 16 or the photoreceptor and the image receiving material 23 so that toner image is between them at the transferring position. When the portion of the intermediate transfer belt 16 facing to the ultrasonic irradiation face 44*a* is defined as face 44*b*, the distance L2 between the ultrasonic wave irradiation face 44*a* and the face 44*b* facing to the face 44*a* is set so that the L2 is corresponded to an integer times of ½ of the wavelength L2 of the ultrasonic waves irradiated from the ultrasonic wave irradiation face 44*a*. The distance L2 between the ultrasonic wave irradiation face 44*a* and the face 44*b* is preferred since the highest sensitivity can be obtained when the L2 is ½ of the wavelength 12.

It is supposed that such the phenomenon is caused by formation of a standing wave between the ultrasonic irradiation face 44*a* of the ultrasonic wave apparatus 40 and the facing face 44*b* by agreement of the phase of the ultrasonic waves irradiated from the ultrasonic irradiation face 44*a* of the ultrasonic wave apparatus 40 and that of the ultrasonic waves reflected by the facing face 44*b*.

When the standing wave is formed, force larger than that the simple irradiation of ultrasonic waves affects to the face 44*a* positioned at the antinode portion of the vibration of the standing wave. For example, when an ultrasonic wave generation element 42 having a resonance frequency of 40 kHz, the wavelength 12 of the irradiated ultrasonic waves is approximately 17 mm even though which is influenced a little by the atmosphere temperature because the value of the 12 is the quotient of the sonic speed in air by the resonance frequency.

Image of light reflected by the original placed on the platen glass 3 and lighted by the light source 5 is read by CCD sensor 9 through the two scanning mirrors 6 and 7 and the focusing lens 8 as image signals of B (blue), G (green) and R (red). The read B, G and R signals are input into an image signal processing means 10 and converted to YMCK (yellow, magenta, cyan and black) signals and temporarily stored in a memory provided in the image signal processing means 10 according to necessity.

The photoreceptor drum 11 is uniformly charged at the designated potential by a charging device 12 and a static latent image is formed by a laser beam scanning means 13. The laser beam scanning means 13 scans the photoreceptor drum 11 by the laser beam according to the image data of each colors of yellow, magenta, cyan and black successively output from the image signal processing means 10, to perform imagewise exposure. Thus the static latent images are formed on the photoreceptor drum 11.

The static latent images formed on the photoreceptor drum 11 are each developed by the developing device 14Y, 14M, 14C and 14K to form yellow, magenta, cyan and black colored images, respectively. The toners of each color are negatively charged and adhered on the area exposed to the laser beam of the photoreceptor drum. One color of image is formed by one rotation of the photoreceptor drum 11, and four colored images are formed by four round of the drum.

The one color image formed by one rotation of the drum is transferred onto the intermediated transfer belt 16 on each time, and the four colored images are piled on the intermediate transfer belt 16 by repeating such the process for four times.

After transference of the four color images onto the intermediate transfer belt 16, the intermediate transfer belt is further circulated and the four color toner images are arrived at the position where the toner images are transferred to the image receiving material. The paper 23 contained in the paper supplying cassette 21 is conveyed by the conveying roller 22 synchronizing with the arrival of the piled toner images to the transferring position and further conveyed by the register roller 28 to the position of transfer from the intermediate transfer belt 16 to the image receiving material.

At the position of transfer from the intermediate transfer belt 16 to the image receiving material, the toner images on the intermediate transfer belt 16 are transferred onto the image receiving material by the ultrasonic wave generation element 42 and the horn 41.

FIG. 5 is a schematic illustration showing the transferring position of the intermediate transfer belt 16 and the image receiving material. At the transferring position where the intermediate transfer belt 16 and the image receiving material or paper 23 are faced to each other, the ultrasonic wave generation element 42 and the horn 41 are provided on back side of the paper 24. As is shown in FIG. 5, the end portion of the horn 41 is vibrated in the same phase (piston vibration) in the direction of the arrow and the standing wave is formed between the intermediate transfer belt 16 and the paper 24 around the horn.

To contribute with high efficiency the ultrasonic waves generated by the driving of the ultrasonic wave generation element 42 to the transfer, it is preferable that the paper 23 is strained by sufficient force so as to occur the ultrasonic vibration at the surface of the paper.

At the upper stream side and the lower stream side of the transferring position, pare of rollers 48 are arranged and a conveying belt 47 is provided between them to apply the strain force to the paper 23.

A power source, not shown in the drawing, may be attached to the rollers 48 and the conveying belt 47 for applying voltage in the direction so that the toner particles are not adhered.

As above-mentioned, the toner images piled on the intermediate transfer belt 16 is transferred onto the paper 23 at the transferring position by the ultrasonic waves.

A means utilizing static electricity force or heat for increasing the holding ability of the tone image may be provided to prevent the deformation if the image caused by the rebounding of the toner particle R or the use of paper having small mirror force generated by itself.

In concrete, a means in which a power source is connected to the horn 41 to apply voltage for holding the toner particle R, and a means in which a transferring roller capable of being applied voltage is touched to the back side of the paper 23 are employable. By such the means, charge is given to the paper 23 as to hold the toner particle R on the paper 23. A tension roller may be provided on the opposite side, through the horn 41, of the transfer holding roller may be arranged to prevent the slacking vibration of the paper 23.

The paper on which the toner image is transferred, is fixed by heating and pressure by the fixing device 26 and output on the tray 27, thus a series of color image forming cycle is completed.

On the other hand, the photoreceptor drum 11 after finishing of the image transfer to the intermediate transfer belt 16 is introduced to the next image forming cycle after removing of the toner remained on the surface by cleaning device 32. The intermediate transfer belt 16 after finishing of the image transfer to the paper 23 is introduced to next image forming cycle after removing of the toner remained on the surface of the intermediate transfer belt 16 by cleaning device 33.

As above-described, it is possible in the image forming apparatus employed in the invention to fly the toner particle for transferring by utilizing the sonic irradiation force of the ultrasonic standing wave on the occasion of transfer the toner image on the intermediate transfer belt to the image receiving material (paper 23), and the destroying of the toner particle caused by the releasing the particle of the parting agent is avoided by the use of the toner in which the parting agent is dispersed in the specified state so that the occurrence of deformation of image at the time of transfer can be prevented.

The invention can be also applied to the process in which the ultrasonic vibration is applied for transfer the toner image formed on the photoreceptor to the intermediate transfer belt 16 other than the process for transferring the toner image on the intermediate transfer belt 16 to the image receiving material. FIG. 2 is a schematic illustration showing an example of the image forming apparatus in which the toner image on the photoreceptor drum is transferred onto the intermediate transfer belt by the ultrasonic waves transfer method. It is also preferred in FIG. 2 that the gel member 46 is employed as the ultrasonic wave conductive means between the intermediate transfer belt and the ultrasonic apparatus 40 even though the gel member is not displayed in the drawing.

FIG. 3 is a schematic illustration of another full color image forming apparatus employable in the invention. In the image forming apparatus of FIG. 3, the full color toner image formed on the photoreceptor 11 is transferred onto the image receiving material.

In the image forming apparatus of FIG. 3, a unit image of yellow is firstly formed on the belt-shaped photoreceptor. The procedure is the same as that in the formation apparatus for the monocolor image; firstly the surface of the photoreceptor is uniformly charged by the charging device, the photoreceptbr surface is imagewise exposed by the image exposure device and developed by the yellow color toner to form the yellow image.

A magenta, cyan and black images are formed on the same area of the photoreceptor by synchronized timing with the rotation of the photoreceptor 11.

When the photoreceptor 11 is arrived, by the continuation of the moving thereof, at the position of the ultrasonic apparatus corresponding to the facing face 44*b*, the full color toner image is transferred onto the image receiving material 23 conveyed by adjusted timing. The image receiving material 23 carrying the full color toner image is conveyed into the fixing device 26 and the color image is fixed on the image receiving material 23.

It is also preferable in FIG. 3 that the gel member 46 is provided as the ultrasonic wave conducting member between the facing face 44*b* and the ultrasonic apparatus 40.

The photoreceptor 11 is further continuously rotated after transfer of the toner image, and the remained toner and paper powder on the surface of the photoreceptor are removed by the cleaning device 32 having a blade and then the photoreceptor is reused for next image formation.

The production method of the toner will now be described.

Production methods of the toner are not particularly limited. Listed as specific production methods are an emulsion coalescence method, a suspension polymerization method, a dispersion polymerization method, and a dissolution suspension method. The toner production method will now be described which employs an emulsion polymerization coagulation method, mainly based on that is performed via a process in which resinous particles are coagulated with release agent particles of a melting point in the range of 40-750° C.

In the emulsion polymerization coagulation method which is a preferred production method of the toner employed in the present invention, after coagulation of particles, particles are united upon fusing at a higher temperature. Consequently, it is assumed that since applied shear is relatively minor and fusion and unification among particles are performed, it is possible to effectively utilize appropriate compatibility of the aforesaid absorption peak shifting substances.

The emulsion polymerization coagulation method includes a process (hereinafter occasionally referred to a coagulation process) in which at least a resinous particle dispersion prepared by dispersing resinous particles, a colorant dispersion prepared by dispersing colorants, a release agent dispersion prepared by dispersing release agents, and an absorption peak shifting substance dispersion are blended and resinous particles, colorants, and release agents are coagulated to form coagulation particles, and a coagulation particle dispersion is prepared, and a process (hereinafter occasionally referred to as a fusion process) which forms toner particles by heating and fusing the above coagulation particles.

In the toner production method employed in the present invention, if desired, following the above coagulation process, a process is arranged in which a dispersion of minute resinous particles and/or minute other component particles is added so that the above minute particles are adhered to the above coagulation particles (hereinafter occasionally referred to as a "adhesion process") and the resulting adhered particles are heated and fused to form toner particles (a "fusion process"). It is possible to prepare toner via the above processes.

In the above coagulation process, resinous particles, colorants, and release agents in a dispersion are subjected to hetero-coagulation to form coagulated particles. In the aforesaid hetero-coagulation, with the aim of stabilization of the coagulated particles as well as control of a particle size/particle size distribution, it is effective to add ionic surface active agents of a polarity differing from the coagulated particles or compounds of a univalent or higher valent charge such as inorganic metal salts.

Further, in the above fusion process, resins and release agents are fused in coagulated particles. Resinous particles and release agents exhibit low compatibility with each other, or even no compatibility. However, by allowing the aforesaid absorption peak shifting substances to be present together with them, it becomes easier to achieve fusion of coagulated particles, whereby toner particles are formed.

In the case in which the above adhesion process is provided, the above coagulated particles are used as host particles, whereby added minute particles are uniformly adhered, whereby adhered particles are formed. The above adhered particles are formed by hetero-coagulation and the like. In the above adhered particles, during the fusion process, resins in the adhered particles are fused and coalesced, whereby toner particles are formed. According to this method, during the adhesion process, the surface of the adhered particles are covered with minute particles and release agents are substantial enclosed in the core portion of the fused toner particles, whereby advantageously, exposure of the release agents to the surface of toner particles is retarded. Further, by employing minute particles which form the surface of toner particles, it is possible to control the physical surface properties of the toner particles.

In the case of production of the toner employing the emulsion polymerization method, a dispersion in which minute resinous particles are dispersed is used. Listed as materials used for minute resinous particles in such a case are, for example, thermoplastic resins. Specific examples include homopolymers or copolymers (styrene based resins) of styrene such as styrene, para-chlorostyrene, or α-methylstyrene; homopolymers or copolymers (vinyl based resins) of esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate; homopolymers or copolymers (vinyl based resins) of vinylnitrile such as acrylonitrile or methacrylonitrile; homopolymers or copolymers (vinyl based resins) of vinyl ethers such as vinyl methyl ether or vinyl isobutyl ether; homopolymers or copolymers (vinyl based resins) of vinyl methyl ketone, vinyl ethyl ketone, or vinyl isopropenyl ketone; homopolymers or copolymers (olefin based resins) of olefins such as ethylene, propylene, butadiene, or isoprene; non-vinyl condensation based resins such as epoxy resins, polyester resins, polyurethane resins, polyamide resins, cellulose resins, or polyether resins, and graft polymers of these non-vinyl condensation resins with vinyl based monomers.

Of these resins, the vinyl based resins are most preferable. Vinyl based resins exhibit advantages such that by performing polymerization employing compounds such as ionic surface active agents, it is possible to readily prepare a minute resinous particle dispersion. Listed as above vinyl based monomers are those such as acrylic acid, methacrylic acid, maleic acid, cinnamic acid, fumaric acid, vinylsulfonic acid, ethyleneimine, vinylpyridine, or vinylamine, which are employed as a raw material to prepare vinyl based polymer acids or a vinyl based polymer acid salts. Of these vinyl based monomers, in view of ease of vinyl based resin forming reaction, the vinyl based polymer acid is more preferred. Specifically most preferred are dissociative vinyl based monomers having, as a dissociation group, a carboxyl group, such as acrylic acid, methacrylic acid, maleic acid, cinnamic acid, or fumaric acid in terms of degree of polymerization and the control of the glass transition point.

Incidentally, it is possible to determine the concentration of the dissociation group in the above associative vinyl based monomers, employing a quantitative analytical method in which particles, such as toner particles, are dissolved from the surface, described, for example, in "Kobunshi Latex no Kagaku (Chemistry of Polymer Latexes)" (Kobunshi Kanko Kai). Further, employing the above method, it is possible to determine the molecular weight and the glass transition point from the surface to the interior of a particle.

The average particle diameter of minute resinous particles employed in an emulsion polymerization coagulation method is commonly at most 1 μm, but is preferably in the range of 0.01-1 μm. By adjusting the average particle diameter to at most 1 μm, it has been confirmed that the particle size distribution of the finally obtainable electrostatic image developing toner narrows, and at the same time, and performance and reliability of the toner are enhanced due to the retardation of generation of liberated particles. Further, by controlling the average particle diameter of minute resinous particles within the above range, deviation among toner particles is decreased and fluctuations of performance and reliability of the toner is advantageously reduced. Incidentally, it is possible to determine the above average particle diameter employing, for example, Coulter Counter (produced by Coulter Co.).

In the toner production method employing the emulsion polymerization coagulation method, a colorant dispersed dispersion is employed. Listed as colorants which are employed for the above operation are, for example, various pigments such as carbon black, chrome yellow, Hansa yellow, benzidine yellow, Surene Yellow, quinoline yellow, permanent orange GTR, pyrazolone orange, vulcan orange, Watchung Red, permanent red, Brilliant Carmine 3B, Brilliant Carmine 6B, Dupont Oil Red, Pyrazolone Red, Lithol Red, Rhodamine B Lake, Lake Red C, Rose Bengale, aniline blue, or ultramarine blue, chalco-oil blue, methylene blue chloride, phthalocyanine blue, phthalocyanine green, or malachite green oxalate, as well as various dyes such as acridine based, xanthene based, azo based, benzoquinone based, azine based, anthraquinone based, dioxazine based, thiazine based, azomethine based, indigo based, thioindigo based, phthalocyanine based, aniline black based, polymethine based, triphenylmethane based, diphenylmethane based, or xanthene based. These colorants may be employed individually or in combinations of at least two types.

The average diameter of the above colorants is commonly in the range of at most 1 μm, preferably in the range of at most 0.5 μm, but is more preferably in the range of 0.01-0.5 μm. By controlling the average particle diameter of colorant particles to be at most 1 μm, since it is possible to narrow the finally resulting particle size distribution and to minimize the formation of liberated particles, performance and reliability of the toner are enhanced. Further, by controlling the average particle diameter within the above range, deviation among toner particles is decreased to improve dispersibility of toner particles incorporated with various components, whereby fluctuations of performance and reliability of the toner are advantageously reduced. Further, when the average diameter is at most 0.5 μm, advantages are exhibited in which toner particles exhibit excellent color forming properties, color reproduction, and OHP transmission properties. It is possible to determine the above average diameter, employing, for example, a laser diffraction type particle size distribution measurement apparatus.

In the case in which toner is produced employing an emulsion polymerization coagulation method, a release agent dispersed dispersion is employed. Preferably employed are release agents which exhibit performance as described above. The above-described release agents generally exhibit poor compatibility with binding resins of toner particles. By employing such release agents which exhibit poor compatibility with binding resins, plasticization of binding resins due to the presence of release agents is minimized and viscosity of the toner is maintained during fixing to effectively minimize the formation of off-setting.

Further, since release agent result in no plasticization of binding resins, some of release agent particles which exist near the surface are stably retained in the resinous layer. As a result, there is no fear of decreasing the releasing effect due to the decrease in the amount of the release agents. Further, since resinous panicles, which exist in the toner surface, are not plasticized by the release agents, the glass transition point of the surface of toner particles is kept constant to maintain the fluidity of the toner. The releasing effect relates to dispersion units of release agents incorporated in toner particles as well as to the distance from the surface of the toner particle. As the dispersion units increase, or the distance of the release agent from the surface of toner particles decrease, the resulting effect increases.

The content of release agents is preferably 0.1-50 percent by weight with respect to the toner, is more preferably 0.5-40 percent by weight, but is most preferably 1-30 percent by weight. By controlling the above content in the aforesaid range, the resulting releasing effect is sufficiently exhibited and in addition, adhesion of toner onto a fixing roller during fixing, or so-called off-setting tends to not occur. Further, since release agents are not liberated during coagulation, toner does not become fragile. As a result, even though stirring in a development unit is continued over an extended period, toner particles are not crushed, whereby minute particles are not formed.

The average particle diameter of the above release agent particles is preferably at most 1 μm, but is more preferably in the range of 0.01-1 μm. By controlling the average particle damager to be at most 1 μm, it is possible to narrow the particle size distribution of the finally produced toner particles and to minimize the generation of liberated particles, whereby performance and reliability of the toner are enhanced. Further, by controlling the average particle diameter within the aforesaid range, non-uniform presence of the release agents among toner particles is minimized and the dispersibility of release agents in toner particles is improved. As a result, advantageously, fluctuation of the performance and reliability of the toner are minimized. Incidentally, it is possible to determine the above average particle diameter, employing, for example, a laser diffraction type particle size distribution measurement apparatus or a centrifugal type particle size distribution measurement apparatus.

Incidentally, these types of wax are dispersed together with ionic surface active agents, polymer acids, and polymer electrolytes such as polymer bases in a water based medium such as water, and heated to the temperature higher than the melting point and processed employing a homogenizer or a pressure ejection type homogenizer under an application of a weak sharing force, whereby it is possible to easily prepare minute particles of a diameter of at most 1 μm.

When the toner is produced, there is no particular limitation except that in the combination of minute resinous particles, colorants, and release agent, the release agents of a melting point of 40-75° C. are employed, and it is possible to freely select and then use those in response to the purposes. Further, in response to purposes, it is possible to control physical properties of the toner by adding minute particles of other components such as internal agents, charge control agents, inorganic particles, organic particles, slipping agents, or abrasives other than minute resinous particles, colorants, and release agents.

Further, when the toner is produced, minute particles of the aforesaid other components may be added to and dispersed in any of the minute resinous particle dispersion, the colorant dispersion, and the release agent dispersion, or added to and blended with the mixture of the resinous particle dispersion, the colorant dispersion, and the release agent dispersion.

Listed as the above internal additives are, for example, metals and alloys such as ferrites, magnetites, reduced iron, cobalt, manganese, or nickel, as well as magnetic materials containing these metals.

Listed as charge control agents are, for example, quaternary ammonium salt compounds, nigrosine based compounds, dyes composed of aluminum, iron, and chromium dyes, and triphenylmethane based pigments. In order to easily control ionic strength which affects the stability in a coagulation process and a fusion process of the toner production processes, it is preferable to use charge control agents which are hardly soluble in water.

Listed as inorganic particles are, for example, all the particles such as silica, Titania, calcium carbonate, magnesium carbonate, calcium triphosphate, or cerium oxide which are employed as an external additive for the surface of toner particles. Listed as organic particles are, for example, all the particles such as vinyl based resins, polyester resins, or silicone resins which are commonly employed as an external additive for the surface of toner particles. Incidentally, it is possible to use these inorganic and organic particles as a fluidity aid as well as a cleaning aid.

Examples of slipping agents include acid amides such as ethylenebisstearyl acid amide as well as fatty acid metal salts such as zinc stearate or calcium stearate, while examples of abrasives include the aforesaid silica, alumina and cerium oxide.

The average particle diameter of the aforesaid other components employed in the production method of the toner is preferably at most 1 μm, but is more preferably in the range of 0.01-1 μm. By controlling the average particle diameter to at most 1 μm, it is possible to narrow the particle size distribution of the finished toner, whereby the performance and reliability of the toner are enhanced due to minimization of the formation of liberated particles. Further, deviation among toner particles is decreased and the dispersibility of components in toner particles is improved. As a result, fluctuations of performance and reliability of the toner are advantageously minimized. Incidentally, it is possible to determine the above average particle diameter employing a laser diffraction type particle size distribution measurement apparatus and a centrifugal type particles size distribution measurement apparatus.

The formulation of a toner composition containing the resins, colorants, and release agents is as follows. The content of the colorants is at most 50 percent by weight, but is preferably in the range of 2-40 percent by weight, and the content of the release agents is also at most 50 percent by weight, but is preferably in the range of 2-40 percent by weight. Further, the content of other components is not particularly limited as long as the purposes of the present invention are adversely affected. The content of the other components is commonly very small, is specifically 0.01-5 percent by weight, but is preferably in the range of 0.5-2 percent by weight.

Employed as dispersion media of minute resinous particle dispersion, colorant dispersion, release agent dispersion, and other component dispersion in the production method of the toner may, for example, be water-based media. Examples of water based media include water such as distilled water or ion-exchanged water as well alcohols. These may be used individually or in combinations of at least two types.

In the above dispersion, it is preferable that surface active agents are added to the water based media and then mixed. In the production method of the toner, at least the above minute resinous particle desertion and the above colorant dispersion are mixed to form coagulation particles. Even in the case in which the above release agent dispersion is added to the resulting coagulation particles and the above release agent particles are allowed to adhere onto the surface vicinity of the aforesaid coagulation particle, the addition of surface active agents is advantageous to improve the stability of dispersion panicles such as aforesaid minute resinous particles, colorant particles, or release agent particles in water-based media, and further to enhance of the storage stability of the dispersion. Further, it is advantageous in terms of stability of the above coagulation particles in the coagulation process.

Listed as surface active agents are, for example, anionic surface active agents such as those which are sulfuric acid ester salt based, sulfonic acid salt based, phosphoric acid ester based, and soap based; cationic surface active agents such as those which are an amine salt type and a quaternary ammonium salt type; and nonionic surface active agents such as those which are polyethylene glycol based, alkylphenol ethylene oxide addition product based, and polyhydric alcohol based. Of these, preferred are ionic surface active agents and more preferred are anionic and cationic surface active agents.

Surface active agents employable in the aforesaid dispersion, even though their polarity is the same, cause no problem. However, when the polarity of surface active agents incorporated in the aforesaid resinous particle dispersion and the aforesaid colorant particle dispersion is different from that of surface active agents incorporated in the aforesaid release agent dispersion, it is possible to decrease liberation of the release agents. Further, advantageously, it is also possible to decrease liberation of other particles in the following adhesion process.

Generally, anionic surface active agents exhibit a relatively strong dispersion force and result in excellent dispersion of minute resinous particles as well as colorants. Further, in order to disperse release agents, cationic surface active agents are superior to others. Incidentally, it is preferable that nonionic surface active agents are employed together with the above anionic surface active agents or cationic surface active agents. Surface active agents may be employed individually or in combinations of at least two types.

Specific examples of anionic surface active agents include fatty acid soaps such as potassium laurate, sodium oleate, sodium castor oil; sulfuric acid esters such as octyl sulfate, lauryl sulfate, lauryl ether sulfate, or nonyl phenyl ether sulfate; sodium alkylnaphthalenesulfonates such as lauryl sulfonate, dodecybenznesulfoante, triisopropylnaphthalenesulfonte, or dibutylnaphthalenesulfonate; sulfonic acid salts such as naphthalenesulfonate formalin condensation products, monooctylsulfosuccinate, dioctylsulfosuccinate, lauric acid amidosulfonate, or oleic acid amidosulfonate; phosphoric acid esters such as lauryl phosphate, isopropyl phosphate, nonyl phenyl ether phosphate; dialkylsulfosuccinic acid salts such as sodium dioctylsulfosuccinate; sulfosuccinic acid salts such as disodium lauryl sulfosuccinate.

Specific examples of cationic surface active agents include amine salts such as a laurylamine hydrochloric acid salts, stearyl amine hydrochloric acid salts, oleylamine acetic acid salts, stearylamine acetic acid salts, or stearylaminopropylamine acetic acid salts and quaternary ammonium salts such as lauryltrimethylammonium chloride, dilauryldimethylammonium chloride, disearylammonium chloride, or distearyldimerthylammonium chloride, lauryldihydroxyethylammonium chloride, oleylbispolyoxyethylene methylammonium chloride, laurylaminopropyldimethylethylmmonium sulfate, lauroylaminopropyldimethylhydroxyethylammonium perchlorate, alkylbenznedimethylammonium chloride, alkyltrimethylammonium chloride.

Specific examples of nonionic surface active agents include alkyl ethers such as polyoxyethylene octyl ether, polyoxyethylene lauryl ether, polyoxyethylene stearyl ether, or polyoxyethylene oleyl ether; alkylphenyl ethers such as polyoxyethylene octyl phenyl ether or polyoxyethylene nonyl phenyl ether; alkyl esters such as polyoxyethylene laurate, polyoxyethylene stearate, or polyoxyethylene oleate; alkylamines such as polyoxyethylene lauryl aminoether, polyoxyethylene stearyl aminoether, polyoxyethylene oleyl aminoether, polyoxyethylene soy bean aminoether, or polyoxyethylene tallow aminoether; alkylamides such as polyoxyethylene lauric acid amide, polyoxyethylene stearic acid amide, or polyoxyethylene oleic acid amide; vegetable oil ethers; such as polyoxyethylene castor oil ether or polyoxyethylene rapeseed oil ether; alkanolamides such as lauric acid diethanolamide, stearic acid diethanolamide, or oleic acid diethanolamide; sorbitan ester ethers such as polyoxyethylenesorbitan monolaurate, polyoxyethylene sorbitan monopalmeate, polyoxyethylene sorbitan monostearate, or polyoxyethylene sorbitan monooleate.

The content of surface active agents in each dispersion may be in the amount which does not adversely affect the production of the toner, and is generally in a small amount. The specific amount is commonly in the range of 0.01-10 percent by weight, is preferably in the range of 0.05-5 percent by weight, but is more preferably in the range of 0.1-2 percent by weight. By controlling the content to be in the range of 0.01-10 percent by weight, it is possible to desirably maintain the dispersibility of colorant dispersions as well as release agent dispersions, whereby dispersion materials are not subjected to coagulation in each dispersion. Further, even though the stability of each of the particles during the coagulation process may be in a different state, it is possible to perform secured coagulation without liberation of specified particles. Further, by controlling the content within the above range, it has been confirmed that it is possible to narrow the particle size distribution of particles and it is easily control the particle diameter.

Preparation methods of minute resinous particle dispersion are not particularly limited, and it is possible to suitably select a desired method in response to the purpose. For example, its preparation is performed as follows. In the case in which resins in a resinous particle dispersion are homopolymers or copolymers (vinyl based resins) of esters having a vinyl group, vinyl nitrites, vinyl ethers, and vinyl ketones, vinyl based monomers undergo emulsion polymerization or seed polymerization in ionic surface active agents to form minute resinous particles and the resulting resinous particles are dispersed into ionic surface active agents, whereby a minute resinous particle dispersion is prepared.

In the case in which resins in a resinous particle dispersion are those other than homopolymers or copolymers of vinyl monomers, usable resins may be those which exhibit relatively low solubility in water and are soluble in oil solvents. Resins dissolved material which is prepared by dissolving resins in oil solvents is added to water together with ionic surface active agents and polymer electrolytes and the resulting mixture is dispersed employing a homogenizer. Thereafter preparation is finished by evaporation oil solvents by heating and/or pressure reduction.

It is possible to prepare a colorant dispersion by dispersing colorants into a water based medium containing surface active agents. A release agent dispersion is prepared as follows. The release agents are dispersed into water together with ionic surface active agents, polymer acids, and polymer electrolytes such as polymer bases, and while heating to the temperature higher than the melting point, release agents are subjected to formation of minute particles under application of a strong shearing force, employing a homogenizer or a pressure ejection type homogenizer. The dispersion of other components (particles) is prepared by dispersing those into a water based medium containing surface active agents in the same manner as for the colorant dispersion.

Dispersing methods are not particularly limited. For example, listed are prior art homogenizers such as a rotation shearing type homogenizer, a ball mill having media, a sand mill, and a dyno mill.

In the process which prepares a coagulation particle dispersion in the case employing an emulsion polymerization coagulation method, it is preferable to use, as a coagulant, compounds having a univalent or higher valent charge. Listed as such compounds are water-soluble surface active agents such as nonionic surface active agents, acids such as hydrochloric acid, sulfuric acid, nitric acid, acetic acid, or oxalic acid, metal salts such as magnesium chloride, ammonium sulfate, aluminum nitrate, metal salts of inorganic acids such as silver nitrate, copper sulfate, sodium carbonate; metal salts of aliphatic or aromatic acids; metal salts of phenols such as sodium phenolate; metal salts of amino acids; inorganic acid salts of aliphatic or aromatic amines such as triethanolamine hydrochloric acid salts, or aniline hydrochloric acid salt of these, metal salts of inorganic acids are preferred since they exhibit desired performance of the toner such as stability of coagulation particles, and thermal stability and storage stability of coagulants and advantages for the use.

The added amount of these coagulants varies depending on the valence number of the charge but is in the range of a small amount for any valence. It is preferable that in the case of univalence, the added amount is at most three percent by weight, in the case of divalence, is at most one percent by weight, and in the case of trivalence or higher, is at most 0.5 percent by weight. Since a less amount of coagulants is preferred, compounds having higher valence are preferably employed.

Further, employed as absorption point peak shifting substances may be compounds which have at least one polar group, are compatible with minute resinous particles as well as release agents, and have a absorption peak between the absorption peak on the minimum temperature side and the absorption peak on the maximum temperature side of the absorption peaks with respect to the tangent loss (tan δ) temperature of the toner. Specific examples include lower alcohols such as ethanol or butanol; higher alcohols such as octanol, stearyl alcohol, or oleyl alcohol; polyhydric alcohols such as ethylene glycol, propanetriol, erythritol, or tetrapropanetriol, and dehydration condensation products thereof; lower to higher fatty acids such as acetic acid, butyric acid, stearic acid, and behenic acid; oxycarboxylic acids such as salicylic acid; phenols such as naphthol and acids thereof; esters with alcohols, alkyl mineral acids such as sodium stearylsulfate or sodium oleiate; metal salts of higher fatty acids; sulfur containing compounds such as thioalcohol, thioether, and thioalcohol; amines such as alkylamine; and others such as anilines, urethanes, or silicones.

These may be employed individually or in combinations of a plurality of types. It is preferable that the absorption peak which is obtained by plotting with respect to the tangent loss (tan δ) of these compounds is between the minimum temperature and the maximum temperature of a plurality of peaks obtained by plotting the tangent loss (tan δ) of these compounds with respect to the temperature. Specifically preferred are higher alcohols, higher fatty acid and esters thereof, and of higher fatty acid metal salts. Listed as higher alcohols are stearyl alcohol, icosanol, docosanol, pentacosanol, hexaconol, octacoxal, triancontanol, dotriancontanol, tetratriancontanol, octanediol, decanediol, dodecanediol, tridecanediol, tetradecanediol, pentadecanediol, hexadecanediol, heptadecanediol, octadecanediol, nonadecanediol, and icosanediol. Listed as higher fatty acid are palmitic acid, stearic acid, nonadecylic acid, arachidic acid, docosanoic acid, lignoceric acid, cerotic acid, montanic acid, and melissic acid, while listed as esters are stearic acid monoglyceride, stearic acid diglyceride, stearic acid triglyceride, docosanoic acid monoglyceride, docosanoic acid diglyceride, stearylstearic acid, palmitylpalmitic acid, docosanyldocosanoic acid, stearylcerotic acid, docosanylmontanic acid. Listed as higher fatty acid metal salts are sodium stearate, calcium stearate, zinc stearate, soduum arachidate, and sodium docosanate.

When the above absorption peak shifting compounds are employed, the movement temperature of a plurality of absorption peaks which are obtained by plotting the tangent loss (tan δ) of the toner versus temperature is at most 40° C. It is not preferable that it exceeds 40° C. due to the following reason. When it exceeds 40° C., the aforesaid minute resinous particles and the aforesaid release agents tend to become more compatible to lower the Tg of the toner, whereby the storage stability is degraded.

In order to exhibit the effects of the present invention, the amount of absorption peak shifting compounds added to toner is in the range of 0.1-100 percent by weight with respect to the release agents, is preferably in the range of 1.0-50 percent by weight, but is more preferably in the range of 1.0-30 percent by weight. Minute resinous particles as well as release agents are not affected by the addition of absorption peak shifting compounds by controlling their added amount to be 0.1-100 percent by weight.

Minute inorganic particles composed silica, alumina, titania, or calcium carbonate and resinous particles composed of vinyl based resins, polyester resins, or silicone resins may be added onto the surface of the toner in a dry state, employing a shearing force. These inorganic particles as well as resinous particles function as external additives such as a fluidity aid or a cleaning aid.

The molecular weight distribution of resins employed in the toner, namely the ratio (Mw/Mn) of weight average molecular weight (Mw) to number average molecular weight (Mn), determined by gel permeation chromatography is commonly in the range of 4-30, is preferably in the range of 4-20, but is more preferably in the range of 5-15.

When the molecular weight distribution (Mw/Mn) is controlled to the range of 4-30, the transparency, smoothness, and color mixture properties of fixed images are sufficiently exhibited. Specifically, in the case in which toner images are formed on film sheets for the use of OHP, light is sufficiently transmitted, whereby projected images become clear and bright, and further exhibit desired color reproduction. Further, since the decrease in viscosity of the toner during fixing at high temperatures, no off-setting results. As noted above, when the molecular weight distribution (Mw/Mn) is within the range of the above numeric values, the transparency, smoothness and color mixture properties of fixed images result as desired, and the decrease in viscosity of electrostatic image developing toner during fixing at high temperatures is minimized, whereby it is possible to effectively control the generation of off-setting.

The toner employed in the present invention exhibits excellent characteristics such as chargeability, developability, fixability, or cleaning properties, and particularly, the resulting images exhibit excellent smoothness, transparency, color mixture properties and color forming properties. Further, the above toner is not affected by ambient conditions and consistently exhibits and maintains the above characteristics whereby high reliability is obtained. Further, the toner is produced employing the emulsion polymerization coagulation method. As a result, being different from the case in which production is performed employing a kneading pulverization method, it is possible to decrease the average particle diameter and narrow the particle size distribution.

The charge amount of the toner is commonly 10-40 μC/g, but is preferably 15-35 μC/g. By controlling the charge amount of the toner within 10-40 μC/g, it is possible to produce toner images of desired density while minimizing the generation of background stain. The ratio of the charge amount of the toner during summer (30° C. and 85 percent relative humidity) to the same during winter (10° C. and 30 percent relative humidity) is commonly in the range of 0.5-1.5, but is preferably in the range of 0.7-1.3. By maintaining the above ratio, the toner is not affected by ambience, and it is possible to maintain the desired charge amount. As a result, it is possible to consistently produce excellent toner images for the practical use.

In the image forming method, toner may be employed in a single component developing agent in which the toner is employed individually or may be in a double component developing agent in which the toner is combined with carriers. The above carriers are not particularly limited and prior art resins coated carriers are employed which are described in JP-A Nos. 62-39879 and 56-11461.

In resin coated carriers, employed as nucleus particles of carriers are common iron powder, and formulated ferrites and magnetites, and their average particle diameter is appropriately in the range of 30-200 μm. Listed as resins for coating the above nucleus particles are, for example, styrenes such as styrene, para-chlorostyrene, or α-methylstyrene; α-methylene fatty acid monocaroxylic acids such as methyl acrylate, ethyl acrylate, n-propyl acrylate, lauryl acrylate, 2-ethylhexyl acrylate, methyl methacrylate, methacrylic acid, n-propyl methacrylate, lauryl methacrylate, 2-ethylhexyl methacrylate; nitrogen-containing acrylates such as dimethylaminoethyl methacrylate; vinylnitriles such as acrylonitrile or methacrylonitrile; vinylpyridines such as 2-vinylpyridine or 4-vinylpyridine; vinylethers such as vinyl methyl ether or vinyl isobutyl ether; vinylketones such as vinyl methyl ketone, vinyl ethyl ketone, or vinyl isopropenyl ketone; olefins such as ethylene or propylene; homopolymers of vinyl based fluorine containing monomers such as hexafluoroethylene, or copolymers composed of at least two types of monomers; silicones such as methylsilicone or methylphenylsilicone; polyesters containing bisphenol or glycol; and resins such as epoxy resins, polyurethane resins, polyamide resins, cellulose resins, polyether resins, or polycarbonate resins. These resins may be employed individually or in combinations of at least two types. The amount of resins to be coated is commonly in the range of 0.1-10 parts by weight with respect to the nucleus particles, but is preferably 0.5-3.0 parts by weight.

For the production of carriers, it is possible to use a heating type kneader, a heating type Henschel mixer, and a UM mixer. Depending on the amount of the above resins to be coated, it is also possible to use a heating type fluidized rolling bed and a heating type kiln. The mixing ratio of the toner to the carrier in the electrostatic image developing agent of the present invention is not particularly limited and is suitably selected in response to proposes.

EXAMPLES

Although an example is given and being explained concretely hereinafter, the embodiment of the present invention is not limited to this example. Incidentally, in the example below, "parts" means mass parts. Moreover, the Dp50 of toner was measured with COULTER COUNTER (Coulter company make, TA2 type). The average particle diameter of resin fine particles, a color particle, and release agent particles mentioned above were measured by a laser diffraction type particle size analyzer (Horiba, Ltd. make, LA-700). Furthermore, the molecular weight and molecular weight distribution of resin in resin fine particles and toner particles were measured by the use of gel permeation chromatography (the TOSOH CORP. make, HLC-812OGPC). The glass transition point of the resin in resin fine particles and toner particles was measured under heating-rate of 3 degrees C./min using the differential scanning calorimeter (Shimadzu-corp. company make, DSC-50).

(Production of toner particles)
<Preparation of resin fine particles dispersion liquid>
Preparation of resin fine particles dispersion liquid (1)

| | |
|---|---|
| Styrene (Wako Pure Chem manufactured by) | 355 parts |
| Butyl acrylate (manufactured by Wako Pure Chem.) | 45 parts |
| Acrylic acid (manufactured by Wako Pure Chem.) | 8 parts |
| Dodecyl mercaptan (manufactured by Wako Pure Chem.) | 8 parts |

A solution in which the above-mentioned compositions were mixed and dissolved was prepared beforehand, 8 parts of nonionic surfactants (manufactured by Mitsuhiro Formation: Noniporu 8.5) and 9 parts of anion nature surfactants (manufactured by Dai-Ichi Kogyo Seiyaku Co., Ltd.: Neogen RK) were dissolved in 583 parts of ion exchanged water, and the above solution was dispersed and emulsified in the ion exchanged water solution. Further, while mixing this solution slowly for 10 minutes, 50 parts of ion exchanged water in which 4 parts of ammonium peroxodisulfate (the product manufactured by Wako Pure Chem.) was dissolved is put in this solution. After performing nitrogen substitution, the solution was heated by an oil bath until the content thereof became 70 degrees C. while stirring, and emulsion polymerization was continued as it was for 6 hours. Then, this reaction liquid was cooled to room temperature, and resin fine particles dispersion liquid (1) was prepared. A part of this resin fine particles dispersion liquid (1) was left alone on an oven of 80° C. so as to remove water content, and when the characteristics of resin fine particles were measured, average particle diameter was 128 nm, glass transition point was 57 degrees C., weight average molecular weight were 38,000 and number average molecular weight was 13000, and molecular weight distribution (Mw/Mn) was 2.92.

| <Preparation of colorant dispersion liquid><br>Preparation of - colorant dispersion liquid (1) | |
|---|---|
| Phthalocyanine pigment<br>(manufactured by Dainissei (Kabu): PV FAST BLUE) | 60 parts |
| Anionic surface active agent (manufactured by Wako Pure Chem.) | 2 parts |
| Ion exchanged water | 300 parts |

After mixing and dissolving the above-mentioned compositions in a solution, the compositions were dispersed by the use of a homogenizer (manufactured by IKA, Ultratalux), whereby a colorant dispersion liquid (1) in which a colorant (phthalocyanine pigment) having an average particle diameter of 150 nm was dispersed was prepared.

| Preparation of colorant dispersion liquid (2) | |
|---|---|
| Magenta pigment (C. I. pigment red 122) | 60 parts |
| Anionic surface active agent (the product manufactured by Wako Pure Chem.) | 2 parts |
| Ion exchanged water | 300 parts |

After mixing and dissolving the above-mentioned compositions in a solution, the compositions were dispersed by the use of a homogenizer (manufactured by IKA, Ultratalux), whereby a colorant dispersion liquid (2) in which a colorant (magenta pigment) having an average particle diameter of 150 nm was dispersed was prepared.

| Preparation of colorant dispersion liquid (3) | |
|---|---|
| Yellow pigment (C. I. pigment yellow 74) | 60 parts |
| Anionic surface active agent (manufactured by Wako Pure Chem.) | 2 parts |
| Ion exchanged water | 300 parts |

After mixing and dissolving the above-mentioned compositions in a solution, the compositions were dispersed by the use of a homogenizer (manufactured by IKA, Ultratalux), whereby a colorant dispersion liquid (3) in which a colorant (yellow pigment) having an average particle diameter of 150 nm was dispersed was prepared.

| Preparation of colorant dispersion liquid (4) | |
|---|---|
| Carbon black (REGAL 330 (made by Cabot Corp.)) | 60 parts |
| Anionic surface active agent (manufactured by Wako Pure Chem.) | 2 parts |
| Ion exchanged water | 300 parts |

After mixing and dissolving the above-mentioned compositions in a solution, the compositions were dispersed by the use of a homogenizer (manufactured by IKA, Ultratalux), whereby a colorant dispersion liquid (2) in which a colorant (carbon black) having an average particle diameter of 150 nm was dispersed was prepared.

| <Preparation of release agent particle dispersion liquid><br>Preparation of release agent particle dispersion liquid (1) | |
|---|---|
| Stearic acid stearyl (melting point of 58 degrees C.) | 100 parts |
| Anionic surface active agent<br>(Lion company make: Reparu 860K) | 3 parts |
| Ion exchanged water | 500 parts |

After mixing and dissolving the above-mentioned compositions in a solution, the compositions were dispersed by the use of a homogenizer (manufactured by IKA, Ultratalux) and was subjected to a dispersion process with a pressure discharging type homogenizer, whereby a release agent particle dispersion liquid (1) in which a release agent particle (stearic acid stearyl) having an average particle diameter of 190 nm was dispersed was prepared.

| Preparation of release agent particle dispersion liquid (2) | |
|---|---|
| Behenic acid behenyl (melting point of 75 degrees C.) | 100 parts |
| Anionic surface active agent<br>(Lion company make: Reparu 860K) | 3 parts |
| Ion exchanged water | 500 parts |

After mixing and dissolving the above-mentioned compositions in a solution, the compositions were dispersed by the use of a homogenizer (the product made by IKA, Ultratalux) and was subjected to a dispersion process with a pressure discharging type homogenizer, whereby a release agent particle dispersion liquid (2) in which a release agent particle (Behenic acid behenyl) having an average particle diameter of 190 nm was dispersed was prepared.

| Preparation of release agent particle dispersion liquid (3) | |
|---|---|
| Myristic acid myristyryl (melting point of 40 degrees C.) | 100 parts |
| Anionic surface active agent<br>(Lion company make: Reparu 860K) | 3 parts |
| Ion exchanged water | 500 parts |

After mixing and dissolving the above-mentioned compositions in a solution, the compositions were dispersed by the use of a homogenizer (manufactured by IKA, Ultratalux) and was subjected to a dispersion process with a pressure discharging type homogenizer, whereby a release agent particle dispersion liquid (3) in which a release agent particle (myristic acid myristyryl) having an average particle diameter of 190 nm was dispersed was prepared.

| Preparation of release agent particle dispersion liquid (4) | |
|---|---|
| Paraffin wax<br>(NIPPON SEIRO CO., LTD. make: HNP0190, melting point of 90 degrees C.) | 100 parts |
| Anionic surface active agent<br>(Lion company make: Reparu 860K) | 3 parts |
| Ion exchanged water | 500 parts |

After mixing and dissolving the above-mentioned compositions in a solution, the compositions were dispersed by the use of a homogenizer (manufactured by IKA, Ultratalux) and was subjected to a dispersion process with a pressure discharging type homogenizer, whereby a release agent particle dispersion liquid (4) in which a release agent particle (paraffin wax) having an average particle diameter of 190 nm was dispersed was prepared.

| Preparation of release agent particle dispersion liquid (5) | |
|---|---|
| Polyethylene wax<br>(Toyo Petrolight company make-olywax725, melting point of 98 degrees C.) | 100 parts |
| Anionic surface active agent<br>(Takemoto Fats-and-oils company make: Pionin A-45-D) | 2 parts |
| Ion exchanged water | 500 parts |

After mixing and dissolving the above-mentioned compositions in a solution, the compositions were dispersed by the use of a homogenizer (manufactured by IKA, Ultratalux) and was subjected to a dispersion process with a pressure discharging type homogenizer, whereby a release agent particle dispersion liquid (5) in which a release agent particle (Polyethylene wax) having an average particle diameter of 230 nm was dispersed was prepared.

| <Preparation of absorption peak shifting material dispersion liquid><br>Preparation of absorption peak shifting material dispersion liquid (1) | |
|---|---|
| Stearylstearate<br>(Riken Vitamin Co., Ltd. make, Rikemaru SL-800, the melting point of 55 degrees C., temperature of 69 degrees C. over the absorption peak of tangent loss) | 100 parts |
| Anionic surface active agent<br>(Dai-Ichi Kogyo Seiyaku Co., Ltd. company make: Neogen SC) | 4 parts |
| Ion exchanged water | 500 parts |

After mixing and dissolving the above-mentioned compositions in a solution, the compositions were dispersed by the use of a homogenizer (manufactured by IKA, Ultratalux) and was subjected to a dispersion process with a pressure discharging type homogenizer, whereby a dispersion liquid (1) in which a absorption peak shifting material having an average particle diameter of 190 nm was dispersed was prepared.

| (Production of toner particles)<br>Preparation of agglomerated particle dispersion liquid | |
|---|---|
| Resin fine particles dispersion liquid (1) | 300 parts |
| Colorant dispersion liquid (1) | 15 parts |

-continued

| (Production of toner particles)<br>Preparation of agglomerated particle dispersion liquid | |
|---|---|
| Release agent particle dispersion liquid (1) | 34 parts |
| Absorption peak shifting material dispersion liquid (1) | 6 parts |
| Aluminium sulfate (made by Wako Pure Chem.) | 3 parts |
| Ion exchanged water | 500 parts |

After accommodating the above-mentioned composition in a round shape stainless steel flask, the compositions were dispersed by the use of a homogenizer (manufactured by IKA, Ultratalux) and was subjected to a dispersion process with a pressure discharging type homogenizer, and thereafter was heated stirring to 55 degrees C. in a heating oil bath. After holding for 20 minutes at 55 degrees C., when observing it with an optical microscope, it was confirmed that agglomerated particle whose average particle diameter was 2.7 micrometers was formed.

Preparation of Adhesion Particle Dispersion Liquid 40 parts of resin fine particles dispersion liquid (1) was gently added into the above-mentioned agglomerated particle dispersion liquid, and subjected to heating and churning at 55 degrees C. for 15 minutes. Subsequently, when observed with an optical microscope, it was confirmed that adhesion particles whose average particle diameter was 3.0 micrometers were formed.

Fusion of Adhesion Particles

PH of the above-mentioned adhesion particle dispersion liquid was 2.3. An aqueous solution in which sulfuric acid (made by Wako Pure Chem.) was diluted to 0.5 weight % was gently added in the above-mentioned dispersion liquid so as to adjust pH to 7.2. Subsequently, it was heated to 93 degrees C. while continuing churning and held for 6 hours. Thereafter, a reactive product was filtered and rinsed fully with ion exchanged. Then, cyan toner particles 11C were obtained by drying it with a vacuum dryer.

Subsequently, heating churning was carried out for the liquid at 55 degrees C. for 20 minutes, whereby adhesion particles having average particle diameter of 3.5 micrometers was formed.

Moreover, after adding 40 parts of resin fine particles dispersion liquid (1), heating and stirring at 55 degrees C. was held for 35 minutes, thereby adhesion particle with an average particle diameter of 4.0 micrometers was produced, further it was held for 45 minutes, thereby adhesion particle with an average particle diameter of 4.5 micrometers was produced, and it was held for 55 minutes, thereby adhesion particle with an average particle diameter of 5.0 micrometers was produced. Further, it was held for 70 minutes, thereby adhesion particle with an average particle diameter of 6.0 micrometers was produced, and it was held for 90 minutes, thereby adhesion particle with an average particle diameter of 8.5 micrometers was produced. The obtained cyan toner particles are made as 12C-15C, and comparison 11C-comparison 13C.

Moreover, when agglomerated particle dispersion liquid was prepared, release agent particle dispersion liquid (2)-(5) was used respectively in place of release agent particle dispersion liquid (1), an adhesion particle with an average particle diameter of 4.0 micrometers was produced by the same method as above except the above replacement.

The obtained cyan toner particles are made as 16C-17C, comparison 14C-comparison 15C.

When the above-mentioned agglomerated particle dispersion liquid prepared, colorant dispersion liquid (2)-(4) was used in place of colorant dispersion liquid (1) respectively, magenta toner 11M-17M, comparisons 11M-15M, yellow toner particles 11Y-17Y, comparisons 11Y-15Y, black toner particle 11Bk-17Bk, and comparison 11Bk-15Bk were produced with the same process as the above except the above replacement.

[Addition of external additive]

To each of thus obtained toner particles (C, M, Y, Bk) 1-17 and comparative toner particles (C, M, Y, Bk) 11-15, 0.8 parts by weight of hydrophobic silica, 1.0 part by weight of hydrophobic titanium oxide were added and mixed for 25 minutes by a 10L of Henschel mixer at a circumference speed of the rotating wings of 30 m/s. The shape and the diameter of each of the toner particles were not varied by the addition of the external additives.

The characteristics of each produced toner particle are shown in Table 1-Table 4.

TABLE 1

| Toner particle | Releasing agent Compositions | Melting point (° C.) | Number average diameter (μm) | Variation coefficient of shape coefficient (%) | Number variation coefficient in number particle size distribution (%) | Ratio of toner particle having a shape coefficient in a range of 1.05 to 1.55 (%) | Ratio of toner particle having no corner (%) |
|---|---|---|---|---|---|---|---|
| 11C | Stearic acid stearyl | 58 | 3.0 | 13.7 | 18.3 | 65.3 | 56.8 |
| 12C | Stearic acid stearyl | 58 | 3.5 | 11.9 | 20.0 | 75.4 | 65.4 |
| 13C | Stearic acid stearyl | 58 | 4.0 | 10.0 | 21.5 | 86.1 | 87.4 |
| 14C | Stearic acid stearyl | 58 | 4.5 | 11.5 | 20.8 | 78.5 | 70.0 |
| 15C | Stearic acid stearyl | 58 | 5.0 | 14.0 | 24.0 | 65.4 | 51.8 |
| 16C | Behenic acid behenyl | 75 | 4.0 | 10.2 | 21.0 | 89.6 | 86.4 |
| 17C | Myristic acid myristyryl | 40 | 4.0 | 10.6 | 21.8 | 87.7 | 88.2 |
| Comp. 11C | Stearic acid stearyl | 58 | 2.3 | 20.3 | 10.2 | 62.8 | 48.1 |
| Comp. 12C | Stearic acid stearyl | 58 | 6.0 | 14.1 | 26.0 | 61.5 | 46.3 |
| Comp. 13C | Stearic acid stearyl | 58 | 8.0 | 14.3 | 31.5 | 53.7 | 42.3 |
| Comp. 14C | Paraffin wax | 90 | 7.8 | 18.5 | 30.0 | 56.8 | 46.0 |
| Comp. 15C | Polyethylene wax | 98 | 4.2 | 19.4 | 24.2 | 60.0 | 46.3 |

TABLE 2

| Toner particle | Releasing agent Compositions | Melting point (° C.) | Number average diameter (μm) | Variation coefficient of shape coefficient (%) | Number variation coefficient in number particle size distribution (%) | Ratio of toner particle having a shape coefficient in a range of 1.05 to 1.55 (%) | Ratio of toner particle having no corner (%) |
|---|---|---|---|---|---|---|---|
| 11M | Stearic acid stearyl | 58 | 3.0 | 14.0 | 18.4 | 66.4 | 55.3 |
| 12M | Stearic acid stearyl | 58 | 3.5 | 12.0 | 19.9 | 76.9 | 59.9 |
| 13M | Stearic acid stearyl | 58 | 4.0 | 9.9 | 21.8 | 88.2 | 85.1 |
| 14M | Stearic acid stearyl | 58 | 4.5 | 12.0 | 20.7 | 75.4 | 67.8 |
| 15M | Stearic acid stearyl | 58 | 5.0 | 14.0 | 24.0 | 67.3 | 50.8 |
| 16M | Behenic acid behenyl | 75 | 4.0 | 10.1 | 22.4 | 86.9 | 84.8 |
| 17M | Myristic acid myristyryl | 40 | 4.0 | 10.3 | 22.3 | 87.8 | 88.1 |
| Comp. 11M | Stearic acid stearyl | 58 | 2.3 | 18.8 | 10.3 | 61.5 | 48.0 |
| Comp. 12M | Stearic acid stearyl | 58 | 6.0 | 14.5 | 25.9 | 61.8 | 45.2 |
| Comp. 13M | Stearic acid stearyl | 58 | 8.0 | 13.9 | 34.5 | 54.7 | 41.5 |
| Comp. 14M | Paraffin wax | 90 | 7.8 | 17.5 | 30.5 | 58.6 | 44.7 |
| Comp. 15M | Polyethylene wax | 98 | 4.2 | 19.8 | 23.5 | 61.6 | 47.6 |

TABLE 3

| Toner particle | Releasing agent Compositions | Melting point (° C.) | Number average diameter (μm) | Variation coefficient of shape coefficient (%) | Number variation coefficient in number particle size distribution (%) | Ratio of toner particle having a shape coefficient in a range of 1.05 to 1.55 (%) | Ratio of toner particle having no corner (%) |
|---|---|---|---|---|---|---|---|
| 11Y | Stearic acid stearyl | 58 | 3.0 | 13.0 | 18.1 | 65.3 | 58.3 |
| 12Y | Stearic acid stearyl | 58 | 3.5 | 12.5 | 20.1 | 74.7 | 60.4 |
| 13Y | Stearic acid stearyl | 58 | 4.0 | 10.1 | 22.3 | 85.5 | 85.1 |
| 14Y | Stearic acid stearyl | 58 | 4.5 | 12.0 | 20.6 | 78.3 | 70.0 |
| 15Y | Stearic acid stearyl | 58 | 5.0 | 14.0 | 24.0 | 65.4 | 53.0 |
| 16Y | Behenic acid behenyl | 75 | 4.0 | 9.9 | 22.1 | 87.3 | 83.4 |
| 17Y | Myristic acid myristyryl | 40 | 4.0 | 10.5 | 21.6 | 85.8 | 86.2 |
| Comp. 11Y | Stearic acid stearyl | 58 | 2.3 | 18.8 | 10.0 | 62.3 | 48.0 |
| Comp. 12Y | Stearic acid stearyl | 58 | 6.0 | 14.5 | 25.9 | 61.9 | 45.7 |
| Comp. 13Y | Stearic acid stearyl | 58 | 8.0 | 13.8 | 33.0 | 53.5 | 40.8 |
| Comp. 14Y | Paraffin wax | 90 | 7.8 | 17.8 | 29.1 | 57.1 | 43.8 |
| Comp. 15Y | Polyethylene wax | 98 | 4.2 | 19.4 | 23.5 | 60.4 | 48.6 |

TABLE 4

| Toner particle | Releasing agent Compositions | Melting point (° C.) | Number average diameter (μm) | Variation coefficient of shape coefficient (%) | Number variation coefficient in number particle size distribution (%) | Ratio of toner particle having a shape coefficient in a range of (%) | Ratio of toner particle having no corner (%) |
|---|---|---|---|---|---|---|---|
| 11Bk | Stearic acid stearyl | 58 | 3.0 | 14.0 | 18.0 | 65.1 | 57.8 |
| 12Bk | Stearic acid stearyl | 58 | 3.5 | 12.2 | 20.2 | 75.0 | 60.0 |
| 13Bk | Stearic acid stearyl | 58 | 4.0 | 10.0 | 22.0 | 85.8 | 85.8 |
| 14Bk | Stearic acid stearyl | 58 | 4.5 | 11.8 | 20.5 | 78.0 | 68.2 |
| 15Bk | Stearic acid stearyl | 58 | 5.0 | 13.8 | 23.9 | 66.4 | 50.0 |
| 16Bk | Behenic acid behenyl | 75 | 4.0 | 9.8 | 21.5 | 88.9 | 86.6 |
| 17Bk | Myristic acid myristyryl | 40 | 4.0 | 10.1 | 21.3 | 86.8 | 87.2 |
| Comp. 11Bk | Stearic acid stearyl | 58 | 2.3 | 20.0 | 9.8 | 62.0 | 48.9 |
| Comp. 12Bk | Stearic acid stearyl | 58 | 6.0 | 14.0 | 25.6 | 61.0 | 46.5 |
| Comp. 13Bk | Stearic acid stearyl | 58 | 8.0 | 13.8 | 33.5 | 55.5 | 40.0 |
| Comp. 14Bk | Paraffin wax | 90 | 7.8 | 18.0 | 29.5 | 58.8 | 43.1 |
| Comp. 15Bk | Polyethylene wax | 98 | 4.2 | 19.0 | 23.8 | 60.9 | 48.0 |

Preparation of Carrier

[Preparation of Ferrite Core Material]

In a wet type ball mill, 18 mole-% of MnO, 4 mole-% of MgO and 78 mole-% of Fe2O3 were crushed and mixed for 2 hours and dried. After that, the dried mixture was provisionally baked at 900° C. for 2 hours, and crushed by a ball mill for 3 hours and made to slurry. The slurry was granulated and dried by a spray dryer after the addition of a dispersing agent and a binder, and then the dried granules were subjected to main baking at 1,200° C. for 3 hours. Thus ferrite core material granules having an electro-resistivity of $4.3\times10^8$ W·cm were obtained.

[Preparation of Coating Resin]

First, by emulsion polymerization method in which concentration in the aqueous solution media using benzene-sulfonic acid sodium having alkyl group of a carbon atoms 12 as a surfactant was made into 0.3 weight %, copolymer of cyclo hexyl methacrylate/methyl methacrylate (copolymerization ratios 5/5) was synthesized. The copolymer has a volume average diameter of the primary particles of 0.1 μm, a weight average molecular weight (Mw) of 200,000, a number average molecular weight (Mn) of 91,000, a Mw/Mn ratio of 2.2, a softening point (Tsp) of 230° C. and a glass transition point (Tg) of 110° C. Incidentally, in the emulsification state, the above-mentioned resin fine particles conducted azeotropy to water, and the amount of residual monomers was set to 510 ppm.

Next, into a high speed stirring mixer having stirring wings, 100 parts by weight of the ferrite core granule and 2 parts by weight of the above-described resin fine particle were put and stirred for 30 minutes at 120° C. so as to be obtain resin coated carrier having a volume average particle diameter of 61 μm by utilizing the effects of the mechanical impact.

<<Preparation of Developer>>

Each toner particles, in which an external addition agent was added, of 11C-17C, 11M-17M, 11Y-17Y, 11Bk-17Bk and comparison toner of comparison 11C-comparison 15C, comparison 11M-comparison 15M, comparison 11Y-comparison 15Y, and comparison 11Bk-comparison 15Bk were mixed with the above-mentioned carrier, thereby developer of each color having toner concentration of 6 weight % was prepared respectively. The developers of each color were combined as shown in Table 5 so as to make Developer Sets 11 trough 17 and Comparative Developer Sets 11 through 15.

TABLE 5

| Developer set | Toner particle | | | |
|---|---|---|---|---|
| No. | Black(Bk) | Yellow(Y) | Magenta(M) | Cyan(C) |
| Developer set 11 | 11Bk | 11Y | 11M | 11C |
| Developer set 12 | 12Bk | 12Y | 12M | 12C |
| Developer set 13 | 13Bk | 13Y | 13M | 13C |
| Developer set 14 | 14Bk | 14Y | 14M | 14C |
| Developer set 15 | 15Bk | 15Y | 15M | 15C |
| Developer set 16 | 16Bk | 16Y | 16M | 16C |
| Developer set 17 | 17Bk | 17Y | 17M | 17C |
| Comp. Developer set 11 | Comp. 11Bk | Comp. 11Y | Comp. 11M | Comp. 11C |
| Comp. Developer set 12 | Comp. 12Bk | Comp. 12Y | Comp. 12M | Comp. 12C |
| Comp. Developer set 13 | Comp. 13Bk | Comp. 13Y | Comp. 13M | Comp. 13C |
| Comp. Developer set 14 | Comp. 14Bk | Comp. 14Y | Comp. 14M | Comp. 14C |
| Comp. Developer set 15 | Comp. 15Bk | Comp. 15Y | Comp. 15M | Comp. 15C |

Experiment 1

Image forming experiments were carried out employing the above-described developers and the full color image forming apparatus shown in FIG. 1. The ultrasonic waves to be applied to the photoreceptor and the image receiving material during the transferring step was generated by the following conditions.

Conditions of the Ultrasonic Wave Generating Apparatus

Distance L2 between the ultrasonic waves irradiating face to the face facing to the irradiating face: 4.25 mm Ultrasonic generating element has:

Resonance frequency: 40 kHz

Output electric power: 5 W

The fixing was carried out by the method employing the heating roller set at 165° C. and at a line speed of 420 mm/sec.

Under the above conditions, 100,000 sheets of image formation were carried out.

The same evaluations were performed about image formation under a low temperature and low humidity condition at 10° C. and 20% RH, referred to as LL, and a high temperature and high humidity condition at 30° C. and 85% RH, referred to as HH; the fluctuation of the image formation is considerably expanded under such the conditions.

Concrete Evaluation Items ere as Follows.

Evaluation of Transfer Ability

<Transfer Efficiency>

The color difference between the first printed image and the 100,000th print image was evaluated as the indicator of the variation of the transfer efficiency due to an influence of ultrasonic vibration. The color difference was evaluated by the following procedure.

Concretely, the colors of the solid image of secondary colors (red, green and blue) formed on the first and 100,000th images each printed under the both of the conditions were measured by Macbeth Color-eye 7000 and the color difference was calculated by CMC (2:1) color difference equation.

When the color deference calculated by the CMC (2:1) color difference formula is not more than 5, it was judged that the variation of the color of the formed images was within the acceptable range and the good transfer efficient was maintained.

<Image Disturbance>

As evaluation of image disturbance, to evaluate image disturbance under the influence of the oscillation given at the time of a transfer. The overlapping condition of a line drawing in which each dot was made by toner of four color was evaluated. The line drawing was formed in a form of a straight line with a width of 0.5 mm in a cross direction to the developing direction of image formation apparatus, the overlapping condition of each line of four color was evaluated with a 10-time magnifying glass. It was judged by the following ranks.

A: All the lines of four color were overlaped to become the beautiful black line.

B: Although a monochromatic line was confirmed with the magnifying glass, there was nor problem on a practical use.

C: The lines were not overlapped, Non-acceptance.

In the evaluation of the resolution, situation of the occurrence of scattering around the image was evaluated together with. The observation results of the scattering were classified into the following four ranks.

A: No scattering was observed around the image even when the image was observed through the loupe.

B: Although scattering was observed around the line with a magnifying glass, there was nor problem on a practical use.

C: The scattering around the line was observed.

D: The scattering was considerably occurred so that the lines were indistinguishable. Fixable evaluation <Anti-Offset Ability>

After printing of 100,000 sheets, white paper was printed and the situation of the contamination caused by the offset and that of the surface of the heating roller by the toner were visually evaluated. For the evaluation, thick high quality paper with a weight of 200 g/m$^2$ was employed and a line image having a width of 0.3 mm and a length of 150 mm was formed in the direction the same as the progressing direction of the paper.

A: Both of the offset image on the white paper and the toner contamination on the heating roller were entirely not observed.

B: Though any offset image on the white paper was not confirmed, the toner contamination of the heating roller was observed.

C: The offset image was confirmed on the white paper.

The evaluation ranks A and B was acceptable and rank C was unacceptable for practical use.

<Occurrence of Jamming by Winding>

After printing of 100,000 sheets of image, the line speed was changed from 420 mm/sec to 840 mm/sec while the temperature of the heating roller was maintained at 165° C., and the image formation was performed to evaluate the winding of the paper.

A: Any jamming caused by fault of separation from the fixing roller and any mark of the claw were not observed.

B: Though any jamming by fault of the separation from the fixing roller did not occur, the claw marks were observed some degree (no problem in the practical use).

C: The jamming by winding occurred.

<Filming on the Photoreceptor>

The surface of the photoreceptor was visually observed after printing of 500,000 sheets to judge the presence of the filming.

<Uniformity of Halftone Image>

Degradation of the uniformity of the halftone image accompanied with the variation of the transferring ability caused by the occurrence of the filming was evaluated. The norm of the evaluation was as follows.

A: The image was uniform without unevenness.

B: Although streak-shaped thin unevenness was observed, there was no problem for practical use.

C: Although several streak-shaped thin unevenness were observed, there was no problem for practical use.

D: Presence of 5 or more obvious unevenness lines was confirmed.

The results are shown in Tables 6 and 7.

TABLE 6

| | | Transferring ability | | | | | | | | | Evaluation of filming on photoreceptor | |
|---|---|---|---|---|---|---|---|---|---|---|---|---|
| | | Color | | | Thin line overlapping | | Scattering occurrence | | Fixing ability | | | Uniformity |
| | Developer set | Dif. | | | | 100000 | | 100000 | Offset | Winding | Filming | of half |
| | No. | R | G | B | Initial | sheets | Initial | sheets | resistance | tendency | occurrence | tone |
| Exam. 1 | Developer set11 | 4 | 4 | 5 | B | B | A | B | B | B | No | B |
| Exam. 2 | Developer set12 | 3 | 3 | 4 | A | A | A | B | A | B | No | A |
| Exam. 3 | Developer set13 | 2 | 2 | 1 | A | A | A | A | A | B | No | A |
| Exam. 4 | Developer set14 | 3 | 2 | 3 | A | B | A | B | A | B | No | A |
| Exam. 5 | Developer set15 | 5 | 4 | 4 | B | B | A | B | B | B | No | B |
| Exam. 6 | Developer set16 | 2 | 2 | 1 | A | A | A | A | A | B | No | A |
| Exam. 7 | Developer set17 | 2 | 1 | 2 | A | A | A | A | A | B | No | A |
| Comp. 1 | Comp. Developer set11 | 6 | 5 | 6 | B | C | B | C | D | D | Yes | D |
| Comp. 2 | Comp. Developer set12 | 7 | 8 | 7 | C | C | B | C | B | C | Yes | C |
| Comp. 3 | Comp. Developer set13 | 9 | 9 | 8 | C | C | C | D | D | C | Yes | D |
| Comp. 4 | Comp. Developer set14 | 8 | 7 | 8 | C | C | B | C | D | D | Yes | D |
| Comp. 5 | Comp. Developer set15 | 8 | 8 | 7 | B | B | B | C | D | D | Yes | C |

TABLE 7

| | | Transferring ability | | | | | | | | | Evaluation of filming on photoreceptor | |
|---|---|---|---|---|---|---|---|---|---|---|---|---|
| | | Color | | | Thin line overlapping | | Scattering occurrence | | Fixing ability | | | Uniformity |
| | Developer set | Dif. | | | | 100000 | | 100000 | Offset | Winding | Filming | of half |
| | No. | R | G | B | Initial | sheets | Initial | sheets | resistance | tendency | occurrence | tone |
| Exam. 8 | Developer set11 | 5 | 5 | 5 | B | B | A | B | C | B | No | B |
| Exam. 9 | Developer set12 | 4 | 3 | 4 | A | B | A | B | A | B | No | A |
| Exam. 10 | Developer set13 | 2 | 1 | 2 | A | A | A | A | A | B | No | A |
| Exam. 11 | Developer set14 | 3 | 4 | 4 | A | B | A | B | A | B | No | A |
| Exam. 12 | Developer set15 | 5 | 5 | 4 | B | B | A | B | B | C | No | B |
| Exam. 13 | Developer set16 | 1 | 2 | 2 | A | A | A | A | A | B | No | A |
| Exam. 14 | Developer set17 | 2 | 1 | 2 | A | A | A | A | A | B | No | A |
| Comp. 6 | Comp. Developer set 11 | 6 | 6 | 7 | B | C | B | C | D | D | Yes | D |
| Comp. 7 | Comp. Developer set 12 | 8 | 8 | 8 | C | C | C | D | D | D | Yes | D |
| Comp. 8 | Comp. Developer set 13 | 9 | 9 | 9 | C | C | C | D | D | D | Yes | D |
| Comp. 9 | Comp. Developer set 14 | 8 | 9 | 8 | C | C | C | D | D | D | Yes | D |
| Comp. 10 | Comp. Developer set 15 | 9 | 8 | 9 | B | C | C | D | D | D | Yes | D |

Experiment 2

Image formation experiments were carried out employing the foregoing developers and the image forming apparatus shown in FIG. 3.

The conditions of the transfer and the fixing, and evaluation standard were the same as those in Experiment 1.

The results are shown in Tables 8 and 9.

TABLE 8

| | | Transferring ability | | | | | | | Fixing ability | | Evaluation of filming on photoreceptor | |
|---|---|---|---|---|---|---|---|---|---|---|---|---|
| | | Color Dif. | | | Thin line overlapping | | Scattering occurrence | | | | | Uniformity |
| | Developer set No. | R | G | B | Initial | 100000 sheets | Initial | 100000 sheets | Offset resistance | Winding tendency | Filming occurrence | of half tone |
| Exam. 15 | Developer set11 | 4 | 5 | 4 | A | B | A | B | B | B | No | B |
| Exam. 16 | Developer set12 | 3 | 2 | 3 | A | A | A | B | A | B | No | A |
| Exam. 17 | Developer set13 | 2 | 1 | 1 | A | A | A | A | A | B | No | A |
| Exam. 18 | Developer set14 | 2 | 2 | 3 | A | B | A | B | A | B | No | A |
| Exam. 19 | Developer set15 | 5 | 4 | 5 | B | B | A | B | B | B | No | B |
| Exam. 20 | Developer set16 | 2 | 2 | 1 | A | A | A | A | A | B | No | A |
| Exam. 21 | Developer set17 | 1 | 1 | 2 | A | A | A | A | A | B | No | A |
| Comp. 11 | Comp. Developer set 11 | 6 | 5 | 6 | B | C | B | C | D | D | Yes | D |
| Comp. 12 | Comp. Developer set 12 | 7 | 8 | 7 | C | C | B | C | B | C | Yes | C |
| Comp. 13 | Comp. Developer set 13 | 9 | 9 | 8 | C | C | C | D | D | C | Yes | D |
| Comp. 14 | Comp. Developer set 14 | 8 | 7 | 8 | C | C | B | C | D | D | Yes | D |
| Comp. 15 | Comp. Developer set 15 | 8 | 8 | 7 | B | B | B | C | D | D | Yes | C |

TABLE 9

| | | Transferring ability | | | | | | | Fixing ability | | Evaluation of filming on photoreceptor | |
|---|---|---|---|---|---|---|---|---|---|---|---|---|
| | | Color Dif. | | | Thin line overlapping | | Scattering occurrence | | | | | Uniformity |
| | Developer set No. | R | G | B | Initial | 100000 sheets | Initial | 100000 sheets | Offset resistance | Winding tendency | Filming occurrence | of half tone |
| Exam. 22 | Developer set11 | 4 | 5 | 5 | B | B | A | B | C | C | No | B |
| Exam. 23 | Developer set12 | 3 | 3 | 4 | A | B | A | B | A | B | No | A |
| Exam. 24 | Developer set13 | 2 | 2 | 1 | A | A | A | A | A | B | No | A |
| Exam. 25 | Developer set14 | 4 | 4 | 3 | A | B | A | B | A | B | No | A |
| Exam. 26 | Developer set15 | 5 | 5 | 5 | B | B | A | B | C | B | No | B |
| Exam. 27 | Developer set16 | 1 | 2 | 1 | A | A | A | A | A | B | No | A |
| Exam. 28 | Developer set17 | 2 | 2 | 1 | A | A | A | A | A | B | No | B |
| Comp. 16 | Comp. Developer set 11 | 7 | 7 | 7 | B | C | B | C | D | D | Yes | D |
| Comp. 17 | Comp. Developer set 12 | 8 | 8 | 8 | C | C | C | D | D | D | Yes | D |
| Comp. 18 | Comp. Developer set 13 | 9 | 8 | 8 | C | C | C | D | D | D | Yes | D |
| Comp. 19 | Comp. Developer set 14 | 8 | 9 | 8 | C | C | C | D | D | D | Yes | D |
| Comp. 20 | Comp. Developer set 15 | 9 | 8 | 8 | B | C | C | D | D | D | Yes | D |

As can be seen from Tables 6 to 9, it was confirmed that Examples 1 to 28 show excellent transfer performance and fixing performance, and filming performance to a photoreceptor.

Namely, as can be seen from the evaluation result of Tables 6 to 9, even if image formation having an ultrasonic transfer process is conducted under relentless circumstances such as under low temperature and low humidity circumstances or high temperature and high humidity circumstances, it is confirmed that a release agent does not detach from toner under the influence of ultrasonic vibration and an image with high quality and beautiful full color can be formed stably.

What is claimed is:

1. An image forming method, comprising:

forming a latent image on an image carrier;

developing the latent image with a toner to form a toner image on the image carrier; and transferring the toner image from the image carrier to an image receiving material; wherein:

ultrasonic vibrations are applied during the transferring of the toner image, said ultrasonic vibrations being conducted from an ultrasonic wave apparatus via an ultrasonic vibration conductive member provided between the ultrasonic wave apparatus and the image carrier;

the toner has particle diameter (Dp50) at 50 percent accumulation in a number-based particle size distribution between about 3.0 and about 5.0 μm, and comprises a release agent having a melting point between about 40 and about 75° C., said toner being formed by coagulating a resin particle;

the latent image corresponds to a black image;

the toner is a black toner;

the toner image is a black toner image;

the method further comprising:

forming a latent image for a magenta image, a latent image for a cyan image, and a latent image for a yellow image, and developing the latent image for the magenta image with a magenta toner, the latent image for the cyan image with a cyan toner, and the latent image for the yellow image with an yellow toner to form a magenta, cyan and yellow toner images; wherein:

the yellow, cyan, magenta and black toner satisfy the following formulas:

$$0 \leqq [(\text{maximum value of } K) - (\text{minimum value of } K)]/(\text{maximum value of } K) \leqq 0.20 \quad \text{Formula 1:}$$

$$0 \leqq [(\text{maximum value of } K\sigma) - (\text{minimum value of } K\sigma)]/(\text{maximum value of } K\alpha) \leqq 0.30 \quad \text{Formula 2:}$$

$$0 \leqq [(\text{maximum value of } D) - (\text{minimum value of } D)]/(\text{maximum value of } D) \leqq 0.15 \quad \text{Formula 3:}$$

$$0 \leqq [(\text{maximum value of } D\sigma) - (\text{minimum value of } D\sigma)]/(\text{maximum value of } D\sigma) \leqq 0.25; \text{ and} \quad \text{Formula 4:}$$

in Formulas (1)-(4), the maximum value and the minimum value of K refer respectively to the maximum value and the minimum value among average values (Ky, Km, Kc, and Kb) of the shape factor of each of the yellow toner, magenta toner, cyan toner, and black toner; the maximum value and the minimum value of Kσ refer respectively to the maximum value and the minimum value among the variation coefficients (Kσy, Kσm, Kσc, and Kσb) of the shape factor of each of the color toners; the maximum value and the minimum value of D refer respectively to the maximum value and the minimum value among Dp50 (Dy, Dm, Dc, and Db) of each of the colors; and the maximum value and the minimum value of Dσ refer respectively to the maximum value and the minimum value among the number variation coefficients (Dσy, Dσm, Dσc, and Dσb) in the number particle size distribution of each of the color toners.

2. The image forming method of claim 1, wherein the toner has a shape coefficient variation coefficient of 14% or less and a number variation coefficient of about 18 to about 24% in a number particle size distribution.

3. The image forming method of claim 2, wherein the toner contains 65 number % or more of toner particles having a shape coefficient of 1.05-1.55.

4. The image forming method of claim 1, wherein the toner contains 65 number % or more of toner particles having a shape coefficient of 1.05-1.55.

5. The image forming method of claim 1, wherein the toner contains 50 number % or more of toner particles having no corner.

6. The image forming method of claim 1, wherein the Dp50 is 3.5-4.0 μm.

7. The image forming method of claim 1, wherein said transferring the toner image comprises transferring the yellow, magenta, cyan and black toner images on a recording medium.

8. The image forming method of claim 1, wherein said transferring the toner image comprises transferring the yellow, magenta, cyan and black toner images on an intermediate transferring medium.

9. The image forming method of claim 1, wherein a frequency of the ultrasonic vibration is between 40 kHz-2 MHz.

10. The image forming method of claim 1, wherein the release agent comprises a behenyl behenate, a stearyl stearate, a myristyl myristate and a distearyl sebacate.

11. The image forming method of claim 1, wherein the yellow, cyan and magenta toner each has a shape coefficient variation coefficient of 14% or less and a number variation coefficient of about 18 to about 24% in a number particle size distribution, and each of the toner contains 65 number % or more of toner particles having a shape coefficient of 1.05-1.55.

12. The image forming method of claim 1, wherein the toner is formed by coagulating the resin particle and a particle of the release agent.

13. The method of claim 1, wherein the ultrasonic vibration conductive member comprises a gel member.

14. The method of claim 1, wherein the toner contains the release agent in an amount ranging from about 5 to about 15 percents by weight of the toner.

15. The image forming method of claim 1, wherein ultrasonic vibrations are also applied during the development of the latent image.

16. An image forming method, comprising: forming a latent image on an image carrier; developing the latent image with a toner to form a toner image on the image carrier; and transferring the toner image; wherein:

ultrasonic vibrations are applied during the development of the latent image and the transfer of the toner image;

the toner has particle diameter (Dp50) at 50 percent accumulation in a number-based particle size distribution between about 3.0 and about 5.0 μm, and comprises a release agent particle having a melting point between about 40 and about 75° C., said toner being formed by coagulating a resin particle;

the latent image corresponds to a black image;

the toner is a black toner; and the toner image is a black toner image;

the method further comprising:

forming a latent image for a magenta image, a latent image for a cyan image, and a latent image for a yellow image, and developing the latent image for the magenta image with a magenta toner, the latent image for the cyan image with a cyan toner, and the latent image for the yellow image with an yellow toner to form a magenta, cyan and yellow toner images; and said transferring the toner image comprises transferring the yellow, magenta, cyan and black toner images on an intermediate transferring medium.

17. An image forming method, comprising:

forming a latent image on an image carrier;

developing the latent image with a toner to form a toner image on the image carrier;

first transferring the toner image from the image carrier to an image receiving belt; and second transferring the toner image from the intermediate transfer belt to an image receiving material, said image receiving material being conveyed on a conveying belt;

wherein:

ultrasonic vibrations are applied during the second transferring of the toner image, said ultrasonic vibrations being conducted from an ultrasonic wave apparatus via an ultrasonic vibration conductive member provided between the ultrasonic wave apparatus and the conveying belt;

the toner has particle diameter (Dp50) at 50 percent accumulation in a number-based particle size distribution between about 3.0 and about 5.0 μm, and comprises a release agent having a melting point between about 40 and about 75° C., said toner being formed by coagulating a resin particle;

the latent image corresponds to a black image;

the toner is a black toner;

the toner image is a black toner image;

the method further comprising:

forming a latent image for a magenta image, a latent image for a cyan image, and a latent image for a yellow image, and developing the latent image for the magenta image with a magenta toner, the latent image for the cyan image with a cyan toner, and the latent image for the yellow image with an yellow toner to form a magenta, cyan and yellow toner images; wherein:

the yellow, cyan, magenta and black toner satisfy the following formulas:

$$0 \leqq [(\text{maximum value of } K) - (\text{minimum value of } K)]/(\text{maximum value of } K) \leqq 0.20 \quad \text{Formula 1:}$$

$$0 \leqq [(\text{maximum value of } K\sigma) - (\text{minimum value of } K\sigma)]/(\text{maximum value of } K\alpha) \leqq 0.30 \quad \text{Formula 2:}$$

$$0 \leqq [(\text{maximum value of } D) - (\text{minimum value of } D)]/(\text{maximum value of } D) \leqq 0.15 \quad \text{Formula 3:}$$

$$0 \leqq [(\text{maximum value of } D\sigma) - (\text{minimum value of } D\sigma)]/(\text{maximum value of } D\sigma) \leqq 0.25; \text{ and} \quad \text{Formula 4:}$$

in Formulas (1)-(4), the maximum value and the minimum value of K refer respectively to the maximum value and the minimum value among average values (Ky, Km, Kc, and Kb) of the shape factor of each of the yellow toner, magenta toner, cyan toner, and black toner; the maximum value and the minimum value of Kσ refer respectively to the maximum value and the minimum value among the variation coefficients (Kσy, Kσm, Kσc, and Kσb) of the shape factor of each of the color toners; the maximum value and the minimum value of D refer respectively to the maximum value and the minimum value among Dp50 (Dy, Dm, Dc, and Db) of each of the colors; and the maximum value and the minimum value of Dσ refer respectively to the maximum value and the minimum value among the number variation coefficients (Dσy, Dσm, Dσc, and Dσb) in the number particle size distribution of each of the color toners.

18. The image forming method of claim 17, wherein ultrasonic vibrations are also applied during the development of the latent image.

19. An image forming method, comprising:

forming a latent image on an image carrier;

developing the latent image with a toner to form a toner image on the image carrier; and transferring the toner image from the image carrier to an image intermediate transfer belt; wherein:

ultrasonic vibrations are applied during the transferring of the toner image, said ultrasonic vibrations being conducted from an ultrasonic wave apparatus via an ultrasonic vibration conductive member provided between the ultrasonic wave apparatus and the intermediate transfer belt;

the toner has particle diameter (Dp50) at 50 percent accumulation in a number-based particle size distribution between about 3.0 and about 5.0 μm, and comprises a release agent having a melting point between about 40 and about 75° C., said toner being formed by coagulating a resin particle;

the latent image corresponds to a black image;

the toner is a black toner;

the toner image is a black toner image;

the method further comprising:

forming a latent image for a magenta image, a latent image for a cyan image, and a latent image for a yellow image, and developing the latent image for the magenta image with a magenta toner, the latent image for the cyan image with a cyan toner, and the latent image for the yellow image with an yellow toner to form a magenta, cyan and yellow toner images; wherein:

the yellow, cyan, magenta and black toner satisfy the following formulas:

$$0 \leqq [(\text{maximum value of } K) - (\text{minimum value of } K)]/(\text{maximum value of } K) \leqq 0.20 \quad \text{Formula 1:}$$

$$0 \leqq [(\text{maximum value of } K\sigma) - (\text{minimum value of } K\sigma)]/(\text{maximum value of } K\alpha) \leqq 0.30 \quad \text{Formula 2:}$$

$$0 \leqq [(\text{maximum value of } D) - (\text{minimum value of } D)]/(\text{maximum value of } D) \leqq 0.15 \quad \text{Formula 3:}$$

$$0 \leqq [(\text{maximum value of } D\sigma) - (\text{minimum value of } D\sigma)]/(\text{maximum value of } D\sigma) \leqq 0.25; \text{ and} \quad \text{Formula 4:}$$

in Formulas (1)-(4), the maximum value and the minimum value of K refer respectively to the maximum value and the minimum value among average values (Ky, Km, Kc, and Kb) of the shape factor of each of the yellow toner, magenta toner, cyan toner, and black toner; the maximum value and the minimum value of Ku refer respectively to the maximum value and the minimum value among the variation coefficients (Kσy, Kσm, Kσc, and Kσb) of the shape factor of each of the color toners; the maximum value and the minimum value of D refer respectively to the maximum value and the minimum value among Dp50 (Dy, Dm, Dc, and Db) of each of the colors; and the maximum value and the minimum value of Dσ refer respectively to the maximum value and the minimum value among the number variation coefficients (Dσy, Dσm, Dσc, and Dσb) in the number particle size distribution of each of the color toners.

20. The image forming method of claim 19, wherein ultrasonic vibrations are also applied during the development of the latent image.

* * * * *